US009867479B2

(12) United States Patent
Kaplan

(10) Patent No.: US 9,867,479 B2
(45) Date of Patent: Jan. 16, 2018

(54) CHILD SEAT WITH IMMOBILITY ELEMENTS

(71) Applicant: Leonora Kaplan, Passaic, NJ (US)

(72) Inventor: Leonora Kaplan, Passaic, NJ (US)

( * ) Notice: Subject to any disclaimer, the term of this patent is extended or adjusted under 35 U.S.C. 154(b) by 62 days.

(21) Appl. No.: 15/153,754

(22) Filed: May 13, 2016

(65) Prior Publication Data

US 2017/0325600 A1 Nov. 16, 2017

(51) Int. Cl.
*A47D 1/00* (2006.01)
*A47D 1/10* (2006.01)

(52) U.S. Cl.
CPC ..... *A47D 1/10* (2013.01); *A47D 1/006* (2013.01)

(58) Field of Classification Search
CPC ..... A47D 1/10; A47D 1/006
USPC ..... 297/130, 252; 4/572.1, 579
See application file for complete search history.

(56) References Cited

U.S. PATENT DOCUMENTS 3,528,111 A * 9/1970 Chou ..... A47K 3/034 4/572.1
6,314,592 B1 * 11/2001 Stein ..... A47K 3/127 4/572.1
8,291,526 B2 * 10/2012 Parvizian ..... A47C 16/02 4/571.1
2008/0155743 A1 * 7/2008 Allen ..... A47K 3/127 4/572.1

* cited by examiner

*Primary Examiner* — Anthony D Barfield
(74) *Attorney, Agent, or Firm* — Joshua Kaplan, Esq.; Kaplan Law Practice, LLC

(57) ABSTRACT

The present invention discloses a child safety retention device that is shaped substantially in the form of a chair or may be formed from a flexible sack with apertures for insertion of feet that is suspended from a horizontal rails having a mounting brace and upright rails therefrom. The sidewalls or the elliptical rail may contain telescoping shafts for securing the chair to an upright surface, such as a bathtub or a wall. The telescoping shafts have the ability to lock into position between the minimum and maximum extension distances of the telescoping components. The telescoping components, including the shaft and the means of locking the telescoping components at a certain extension length serve to secure and immobilize the retention device inside a bathtub or a shower stall. Suction supports at the bottom of the horizontal member, also known as the seat, further reinforce the secure position of the child safety retention device within a bathtub or a shower stall. The retention device can be foldable for easy storage or for traveling. The utility surface can also function as a utility surface to accept toys, soaps or even snacks. Additional pouches and stows can be provided, including pouches to hide the rigidity elements when the retention device is in folded state.

5 Claims, 20 Drawing Sheets

CHILD SEAT WITH IMMOBILITY ELEMENTS

FIELD OF THE INVENTION

The present invention relates to utility seats with restraint features, in particular, to portable seats for use in childcare or care for disabled individuals.

BACKGROUND OF THE INVENTION

One of the major concerns and preoccupation with child care is safety. Until the child reaches an age of a toddler, safety and proper nutrition are chief concerns. During toddlerhood phase, other development factors begin to play a greater role. However, issues involving safety do not go away at this stage, only intensify. In fact, while concerns involving child care continue to evolve as a child grows, with some concerns getting displaced by others, issues involving safety never become secondary.

During infancy and toddlerhood, two activities become very routine. One is bathing and the other is feeding. Both activities are vital to a healthy development of a child, and yet both are fraught with danger. Parents and childcare workers must be highly alert and vigilant while a child in their care is enjoying his routine bath or a regular meal. A child may be playful and carefree. But a parent or a child care worker is all too aware, that the difference between humdrum and tragedy is one brief unfortunate moment of inattention.

To address known risks, the legislative body developed an area of law specifically dedicated to regulating products intended to be used by children and for children. There is an enormous industry providing solutions to safety concerns. Yet, despite the prominence of the topic of child safety, devices designed to address safety concerns during routine bathing still do not adequately balance issues of safety, cost and practicality.

Presently the area of art dealing with bathing safety is split between highly costly and sophisticated adaptations for the developmentally and psychologically disabled and mainstream devices that offer minimal, if any, safety features. Parents and child care workers have come to terms with the latter shortcoming by compensating with increased vigilance, which at times still leads to near drowning incidents or worse.

SUMMARY OF THE INVENTION

The present invention is a safety retention device that is shaped substantially in a form of a chair and intended to be used for small children or disabled individuals. The sidewalls contain telescoping shafts for securing the chair to an upright surface, such as a bathtub or a wall. The telescoping shafts have the ability to lock into position between the minimum and maximum extension distances of the telescoping components that make up the shaft. The telescoping components, including the shaft and the means of locking the telescoping components at a certain extension length serve to secure and immobilize the retention device inside a bathtub or a shower stall. Suction supports at the bottom of the horizontal member, also known as the seat, further reinforce the secure position of the child safety retention device within a bathtub or a shower stall. The retention device can be foldable, with shafts and frictional elements being folded or tucked away into the device, or into a storage provided by the device for easy storage or for traveling. The utility surface that provides an additional structurally rigid element may also be used as a mounting bracket for toys and other attachment, or can function as a to accept toys, soaps or even snacks. Additional pouches and stows can be provided, including pouches to hide the rigidity elements when the retention device is in folded state.

It is therefore an object of the present invention to provide a safety device to secure an infant or toddler while bathing.

It is another object of the present invention to provide a safety device that is immobilized within a bathtub or shower stall.

It is still another object of the present invention to present multiple safety elements that immobilize the chair provided in the present invention within a bathtub, shower stall, or some other support surface.

It is still another object of the present invention where frictional elements may be removable, foldable and also adjustable by height.

It is yet another object of the present invention to provide a foldable safety device.

It is still another object of the present invention to provide an affordable child safety device that can be secured within most conventional bathtubs or shower stalls.

It is yet another object of the present invention to provide safety elements and attachments on one common elliptical brace.

Still another object of the present invention is to provide a safety device that can easily function as a walker or jumper trainer.

It is still another object of the present invention to serve as a multi-purpose device that can be suspended from a tether or secured within a bathtub.

DESCRIPTION OF THE PREFERRED EMBODIMENTS

Figure 1:
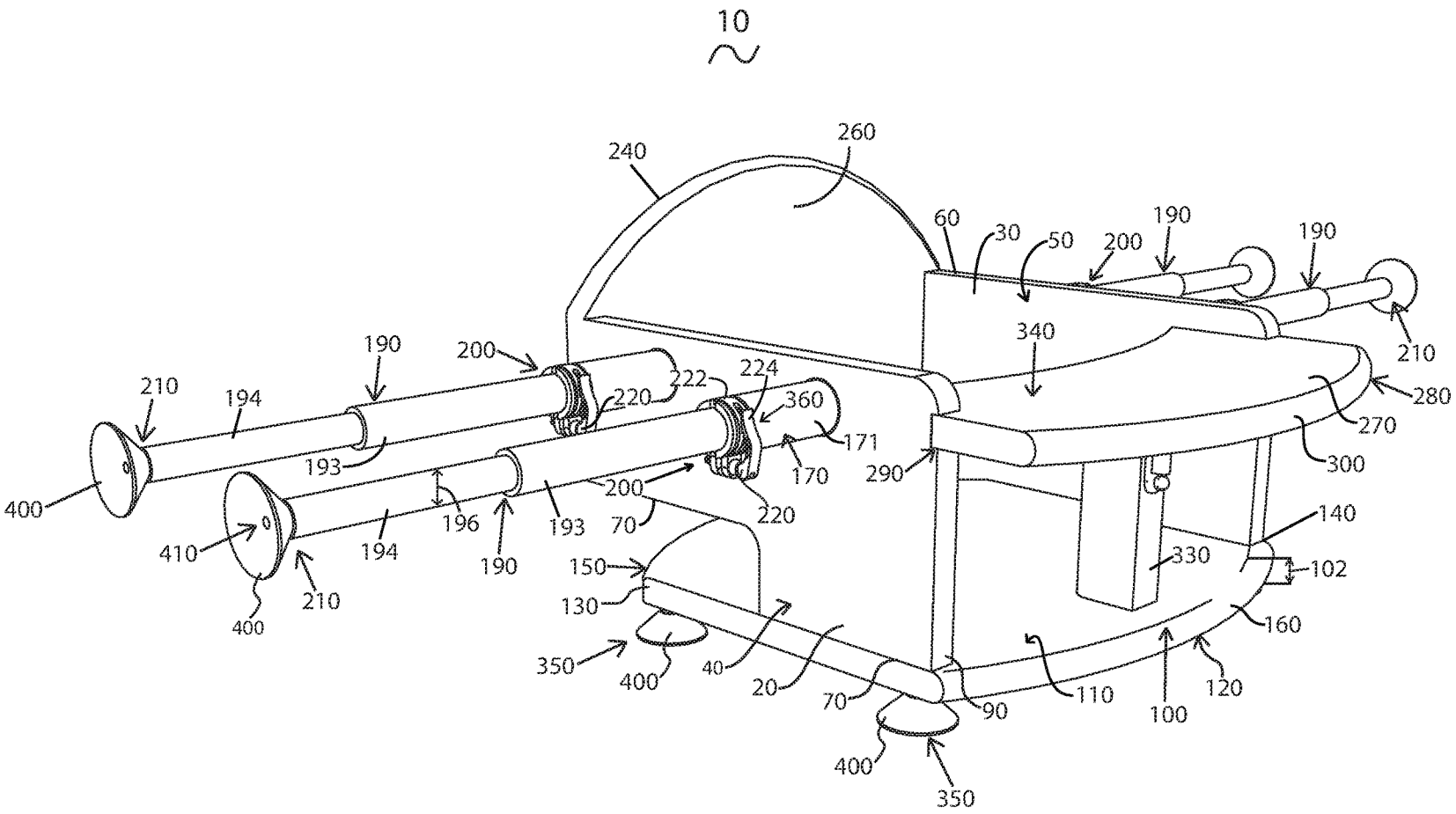
FIG. 1 is a perspective view of one of the embodiments of the present invention.

The preferred embodiments of the present invention will now be described with reference to the drawings. Identical elements in the various figures are identified with the same reference numerals.

Reference will now be made in detail to embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

Turning now descriptively to the drawings, in which similar reference characters denote similar elements throughout the several views, the figures illustrate a child safety seat that securely attaches to inner walls of a bathtub (FIG. 14) using shafts 190 and friction elements 400. The shafts 190 are made up of telescoping elements that are secured at a certain length of extension with threading, constriction band, press screw or a dip pin with corresponding dip openings on either of the telescoping elements 193 and 194. The shafts 190 are used to immobilize the safety retention device 10, also known colloquially as the child seat. Also shown in FIG. 1 are a first vertical barrier 20, a second vertical barrier 30, an outer plane 40, an inner plane 50, a top edge 60, a bottom edge 70, a back end 80, a front end 90, a horizontal member 100, a top surface 110, a first side edge 130, a second side edge 140, a front edge 160, at least one socket 170 for shafts 190, a plunged end 200, a distal end 210, an extension mechanism 220, a rear vertical barrier 240, an inner plane of rear vertical barrier 260, a utility bar 270, a first end of utility bar 280, a second end of utility bar 290, a midway point of utility bar 300, a hinge 310, a crutch barrier 330, a utility surface 340, an immobility element 350, a clamp 360, a suction cup 400 and rotating attachment 410. The rotating attachment may be used to disengage the suction cup 400 from a wall or a support surface by turning or twisting the suction cup 400 until separation is achieved. The socket 170 may be rigid or flexible. A flexible socket 170 would form a flexible sheath around the plunged end 200 of the shafts 190. The shafts 190 and the immobility elements 350 provide the frictional or fastening features of the present invention that secure the apparatus 10 within a support surface such as a bathtub (FIG. 14) or wall of a shower stall. The first vertical barrier 20 and the second vertical barrier 30 are alternatively known as the upright walls or supports. The rear vertical barrier 240 is alternatively referred and known as upright walls, or supports.

The seat 10 is designed to accommodate infants, toddlers and small children, and may therefore be sized appropriately for an intended use. The horizontal member 100 provides support for the buttocks and upper thighs of the child, with feet extending past the front edge 160, with heels of the one seated being supported by the bottom of a bathtub in one example, or the same support surface supports the immobility elements 350. The thickness 102 of the horizontal member 100 may be between half an inch and three inches, depending on the desired use and may be manufactured using metals, alloys, plastics, resins, rubber, a composite material or wood. However these dimensions of the horizontal member 100, otherwise known as the seat, may be two three times as large in an embodiment intended to accommodate bathing of special needs adolescents and adults, or even the elderly. The present invention is particularly useful in many instances where a use of stabilizing support safety device is required. The particular shape of the horizontal member 100, the rear wall 240 (rear upright support) and the upright supports 20 and 30 (first and second vertical barriers) are not particularly dispositive in the present invention, and a plurality of forms and sculpted components may be utilized. The first and second vertical barriers 20 and 30 may have additional rigidity elements embedded internally running either vertically or horizontally to provide additional support against pressure exerted by the end of the socket 170 that is mounted outer plane 40. Such additional rigidity elements will further guard the first and second vertical barriers from buckling inward in response to the inward pressure of the shaft 190 when the latter is fully extended and pressing against a supporting surface.

The first vertical barrier 20 and the second vertical barrier 30 form sidewalls for the horizontal member 100. Both the first and second vertical barriers 20 and 30 have an outer plane and an inner plane 50. The first side edge 130 attaches to the inner plane 50 of the first vertical barrier 20, while the second side edge 140 attaches to the inner plane 50 of the second vertical barrier 30. This attachment may be permanent using fasteners, rivets or welding, or by sculpting the components from a single piece of material, or the components may be attached in a removable fashion, using snap fasteners, clamps, straps or male and female connectors. The designations of"first" and "second" are being used loosely just to describe structural coordination and the terms "first" or "second" can apply to either wall 20 or 30. It is structurally preferable that the horizontal member 100 is attached to the first and second vertical berries 20 and 30 along the bottom edge 70. Alternatively, the horizontal member 100 may be attached to the first and second vertical barriers at any horizontal axis along the surface of the inner plane 50.

The horizontal member 100 and the second and third vertical barriers 20 and 30 may be coupled or mated together in a removable fashion using snap joints for easy assembly or for portability, or may be pivotedly coupled with respect to each other using hinges and pivoting joints, thereby permitting substantial folding. Alternatively, the assembly of the barriers 20 and 30, the rear barrier, the horizontal member 100 may be permanent and utilizing fasteners, rivets, stitching or welding bond all parts together.

The first and second vertical barriers 20 and 30 and for the rear vertical barrier 240 may be manufactured out of fabric, polymers, plastics, leather, or a hard material, such as plastic, wood or metal. The rear vertical barrier 240 is connecting to the first and second vertical barriers 20 and 30 along the back end 80 and back edge 150. This connection may be permanent, using joints, fasteners, rivets, welding or stitching or may be assembled and dismantled at will for more portable embodiments. The connection may also be spanned with hinges or joints to rotate or flex individual parts for better adjustability or portability of the present invention. As seen in later figures, the rear wall, also known as the rear vertical barrier 240, may be made of the same or different materials as the other components of the present invention. The rear vertical barrier 240 may be collapsible together with, or separate from the walls 20 and 30.

The shafts 190 are one of the main safety elements of the present invention. There are preferably four shafts 190, with two shafts along the outer plane 40 of both the first vertical barrier and the second vertical barrier 20 and 30. Alternatively, there may be just one shaft emanating from the first and second walls 20 and 30, and there may be an additional shaft emanating from the rear vertical barrier 240 and even a forward facing shaft on either the utility bar 270 or along the front edge 160.

The shafts 190 are preferably telescopic, with at least three telescopic components. The socket 170 is the mount point of the shaft 190 to the outer plane 40. The socket 170 may be made of a hard material or made as a flexible sheath. All other telescoping members should preferably be made out of durable and light weight material, such as plastic, wood, aluminum or some other metallic alloy. The socket 170 may also form a substantially universal joint at the mount point 171 to the outer plane 40, as shown in later figures. Furthermore, the shaft 190 is made up of at least one additional telescoping member, with each telescoping member being inserted into the telescoping member that is more proximal to the outer plane 40. For example, the first telescoping element 193 slides into and out of the socket 170. The plunged end 200 is secured at the desired depth within the socket 170 with an extension mechanism 220. The extension mechanism is shown as a coupler, having an encircling band 222 and a tension pin with a tension arm 224. Other extension mechanism may be a pressure screw, with the socket 170 having an opening into which a pressure screw is threaded until it jams against the sidewall of the first telescoping element 193. Still another embodiment may have an opening through the sidewall 171 of the socket 170, which is set to receive a spring loaded locking pin emanating from the sidewall 195 of the first telescoping element 193. Whatever the case may be, the first telescoping element 193 moves within the interior of the socket 170 and is able to be fixatedly positioned at a desired extension length by the extension mechanism 220.

The shaft 190 may be further comprised of a second telescoping member 194. The diameter 196 of the second telescoping member 194 is preferably less than the diameter of the first telescoping element 193. The second telescoping element 194 slides within the first telescoping member 193 and may be fixatedly positioned at a desired extension length with the same extension mechanism 220 as used between the socket 170 and the first extension element 193. Alternatively, a different means may be used, such as a threaded coupling between the first telescoping element 193 and the second telescoping element 194. Arguably, a threaded coupling is preferred for the relationship between the first and second telescoping elements 193 and 194 since such a connection would permit a more precise calibration of extension of the shaft 190 and would further permit minute adjustment of extension the shaft 190 to achieve the most secure attachment to the sidewalls of a bathtub, a shower stall, or any other support surfaces, as well as for easy release and decoupling of the shaft from a support surface. The shaft 190 may be comprised of additional telescoping members to enable greater ability to extend or retract the shaft 190, should the connection between telescoping elements 193 and 194 become stuck or jammed in an extended or retracted state.

The distal ends 210 of the shaft 190 preferably contain an immobility element, preferably a suction cup 400. Alternatively a rubber or resinous tip may be implemented in places were a suction cup 400 would not be able to attain a perfect seal throughout the entire rim of the suction cup 400. In such an event, the suction would be weak or may fail altogether. This scenario may occur if the retention device 10 is placed between walls decorated with mosaics. Due to the uneven surface produced by the diminutive mosaic pieces interspersed by grout, the suction cup may not be able to attain a perfect suction. In such an embodiment, the suction cup 400 may be replaced with a resinous or a rubberized tip, or a highly chiseled point capable of digging into the surface supporting the horizontal member 200 so as to produce a high degree of friction induced by the linear radiating outward pressure of the extension shaft 190. The distal ends 210 should preferably comprise universal joints to enable attachment to support surfaces having irregular features, or uneven surfaces or heights.

The retention device 10 preferably contains additional immobility elements 350 disposed on the bottom surface 120. The purpose of the immobility elements 350 is to succor the superior fixation already exerted by the extended shafts 190 that are pressing against the supporting surfaces (for example walls 6 in FIG. 14). Thus while the shafts 190 are keeping the retention device 10 substantially fixed in place, the immobility elements 350 prevent slippage of the retention device 10 on the floor (item 7 in FIG. 14) of the supporting surface, for example the bottom 7 of the bathtub 5 or a floor of a shower stall. Since the immobility elements 350 at the bottom surface 120 usually are not intended to provide the main point of secure affixation of the retention device 10, there is a leeway on what elements are implemented. These can be suction cups 400 as shown in the figures, but may also be friction elements such as ridges protruding outward from the lower surface 120 made from high friction material, such as rubber, resin or fractionized plastic.

Figure 2:
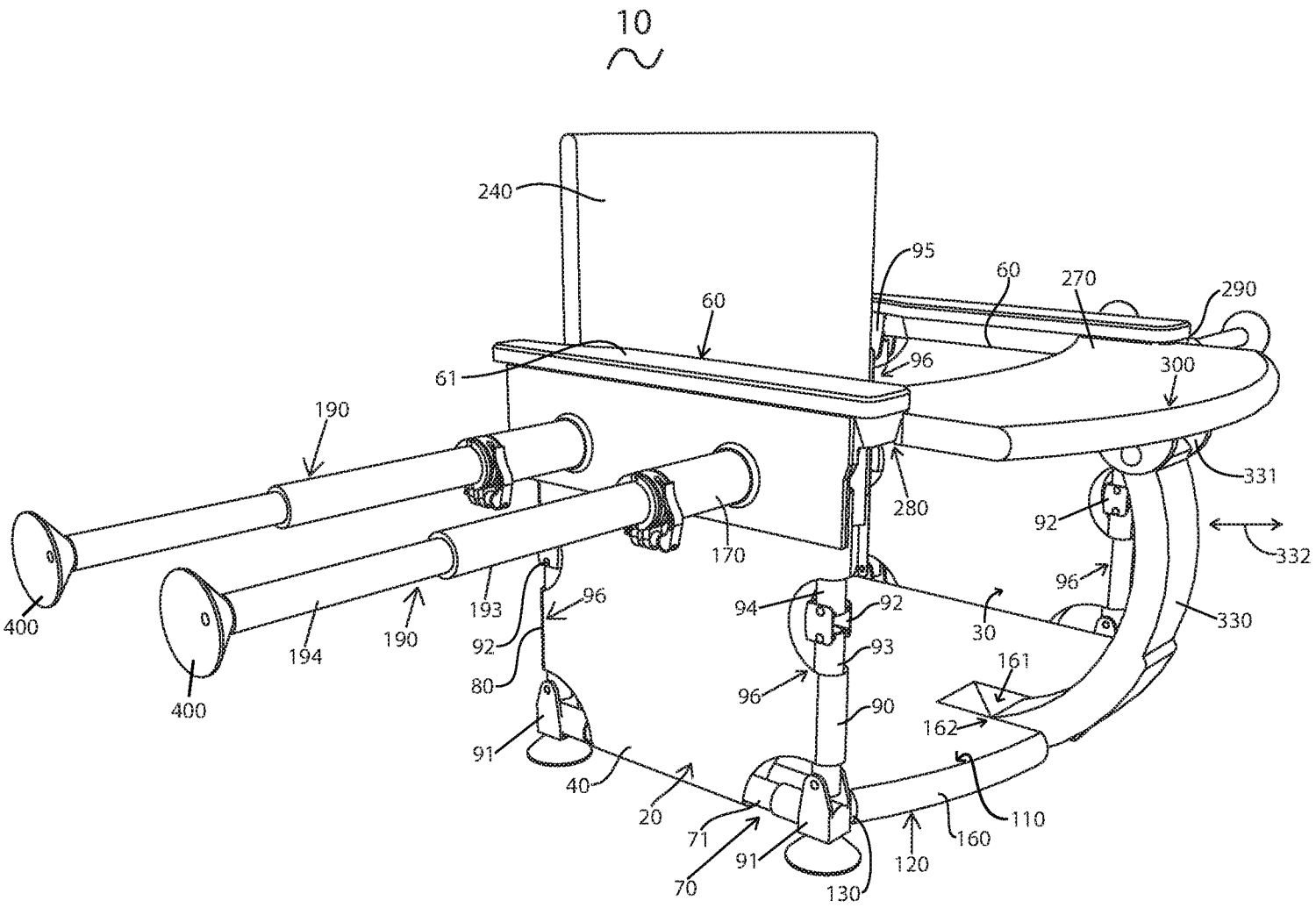
FIG. 2 is a perspective view of another embodiment of the present invention.

FIG. 2 is another embodiment of the present invention, featuring a taller rear wall or support 240, which can be made sculpted to conform to natural curvatures or a human back, or to provide greater support in key areas of the back. The rear support 240 may be made from a flexible material and contain an inflatable orifice inside the rear support 240, to be inflated secure the person inside seat 10 or to provide more comfort of support in certain sections of the back area 240. Shown further are the retention device 10, the first vertical barrier 20, the second vertical barrier 30, an outer plane 40, an inner plane 50, a top edge 60, an arm rest 61, a bottom edge 70, a horizontal rail 71, a back end 80. The front end 90 in this embodiment is comprised of an upright structural element or rail 96 having a bottom section 93 and a top section 94 separated by a middle hinge 92. The top most and bottom most ends, or distal ends of the structural element 96 is a bottom hinge 91 and a top hinge 95. The middle hinge 92 is able to keep the bottom and top sections 93 and 94 locked in place. The rail 96 will remain fully vertical until the lock on hinge 92 is deactivated, allowing the structural element 96 to fold substantially midpoint along the length of the rail 96. The front end 90 and the back end 80 of both first and second walls 20 and 30 contain a collapsible element vertical rail 96, thus permitting the retention device 10 to fold downward.

Furthermore, the embodiment shown in FIG. 2 contains a horizontal member 100, a top surface 110, and a bottom surface 120. The front edge 160 contains an aperture 161 for the bottom hinge or snap 162 of the crotch bar 330. In this embodiment, the crotch bar 330 can swing linearly in the backward or forward direction 332 to permit access and egress for a person using the retention device 10, and to fold the utility bar 270 downward, as part of the process of collapsing the retention device 10 for travel or storage. To further permit collapsibility of the utility bar 270, which in this embodiment is a fully functional mini tabletop, a hinge 331 disposed along the midpoint 300, pivots the utility bar 270 about the crotch bar 330 in either backward or forward directions 332. The utility bar 270 may further comprise a cup holder, soap holder, utility hooks for sponges and brushes, as well as snap or magnetic attachments for soaps and clips. With preferred thickness of the utility bar 270 being preferably between a half of an inch and one and a half of an inch, there is even enough room for a hermetic storage compartment for smart phones, watches and small tablets.

Figure 3:
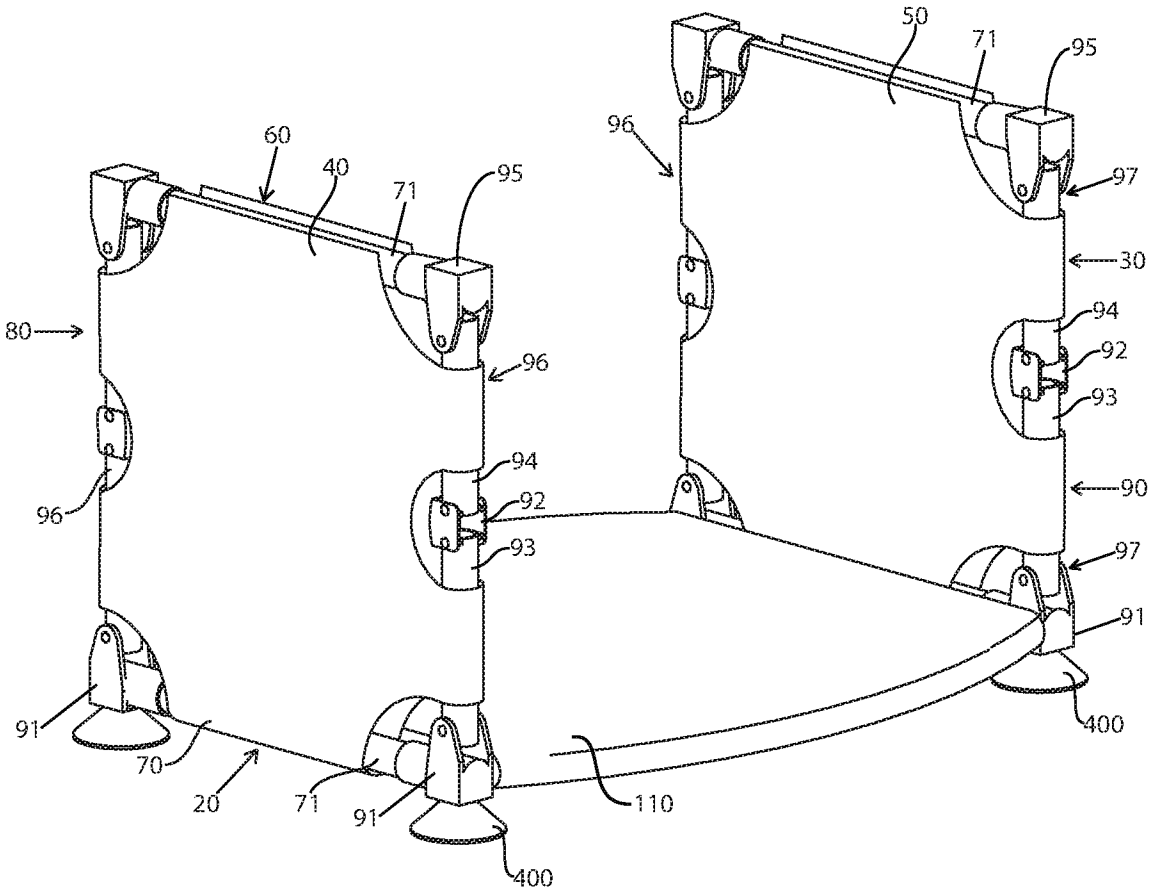
FIG. 3 is a detail diagram of a foldable section of the present invention.

FIG. 3 demonstrates a more detailed diagram of the folding substructure of the present invention that enables the device 10 to assume a smaller, folded profile. The rails 96 form upright supports for the walls 20 and 30. Horizontal rails 71 provide structural support for the lower edge 70 and the upper edge 60. The outer surface 40 and the inner surface 50 are formed from a flexible sheet material, such as fabric made from natural or synthetic fibers. The inner space between inner and out surfaces 50 and 40, may be empty or may contain structural support for the sockets 170. Alternatively, only the inner surface 50 or the outer surface 40 would be present, with edges of such surface wrapping around and substantially concealing the rails 96 and 71.

The latches 92 shown in FIG. 3 preferably have a safety mechanism to immobilize the bottom section 93 and the top section 94 in an upright position. Such mechanism may be a spring loaded tongue to fit into grooves on the part of the bottom and top sections 93 and 94 that are mated with the latch 92. One skilled in the art would appreciate that other forms and latches of securing mechanisms are available to keep the two sections 93 and 94 in an upright and fully unfolded position. On the distal ends 97, the sections 93 and 94 pivot about hinges 91 and 95 respectively, that permit the sections 93 and 94 to fold against the top and bottom rails 71 when folded, and to swing linearly until ninety degree angle with respect to the rails 71, as shown in the figure, to permit fully unfolded stance. The rails 96 and 71 may be tubular or paralegromatic in shape, and may be hollow or solid. For greater stability and tip-over protection, the rails 96 and 71 may be weighted by utilizing an internal filler, by being made of a solid material or by using thicker and heavier hollow tubes.

Figure 4A:
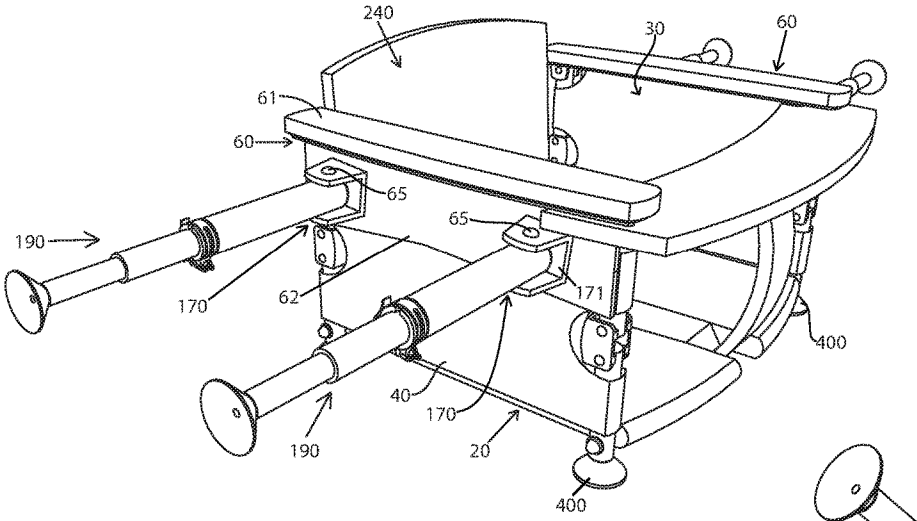
FIGS. 4A and 4B demonstrate different perspective views of one embodiment of the present invention.
Figure 4B:
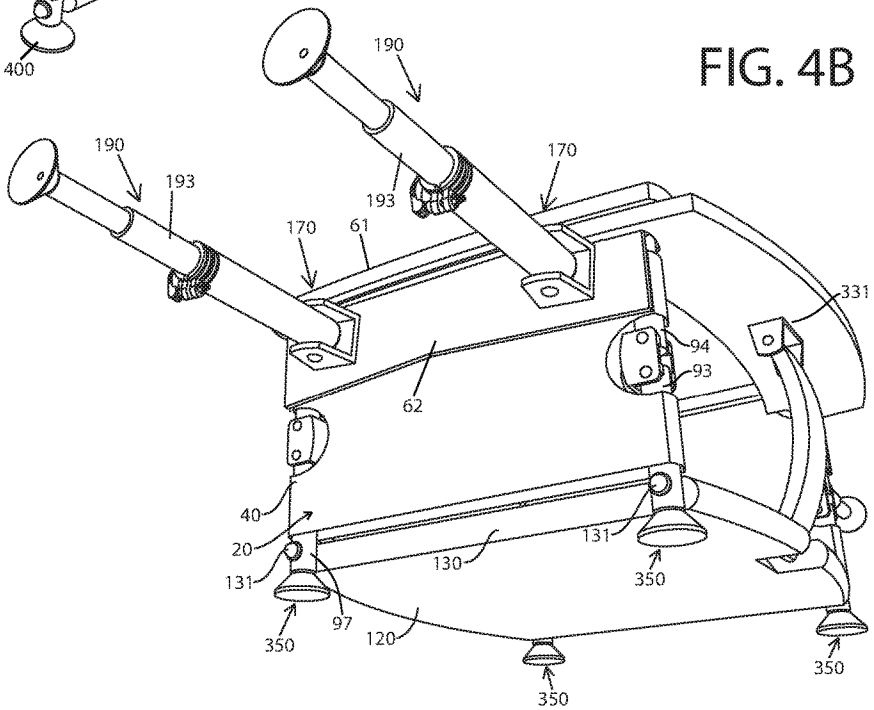

The parallel upright supports 96 shown in FIG. 3 provide support for the rear upright support 240. Since the upright supports 20 and 30 are preferably soft and pliable, to enable for easy folding and unfolding, the shaft 190 need to be mounted on an external hard flap 62. The shaft 190 itself is mounted on a joint that is capable of pivoting in a 180 degree linear arch to fold and unfold about the pivot 65, while the hinge 171 of the socket 170 may be rotated 360° about its axis. This configuration is demonstrated clearly in FIGS. 4*a* and 4*b*. Also shown in FIG. 4*b* is that the horizontal member is attached to the distal ends 97 with fasteners 131. These fasteners 131 may be removable. Given the embodiment depicted in FIG. 4*b*, the fastener may double as a pivot for the folding section 93, since the hinge 91 shown in prior figures may be replaced with this pivot.

Figure 5A:
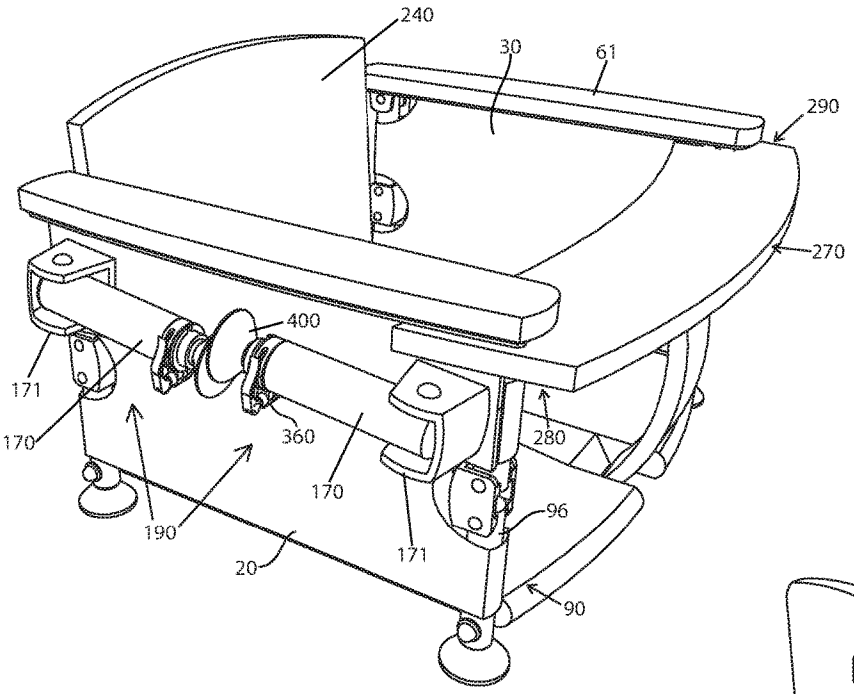
FIGS. 5A and 5B demonstrate a folding capability of the shaft and telescoping elements.
Figure 5B:
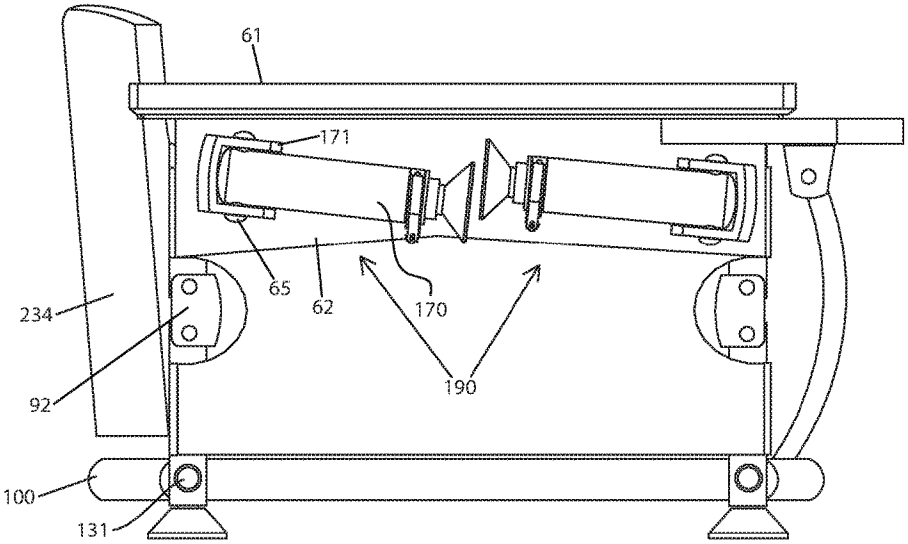
Figure 14:
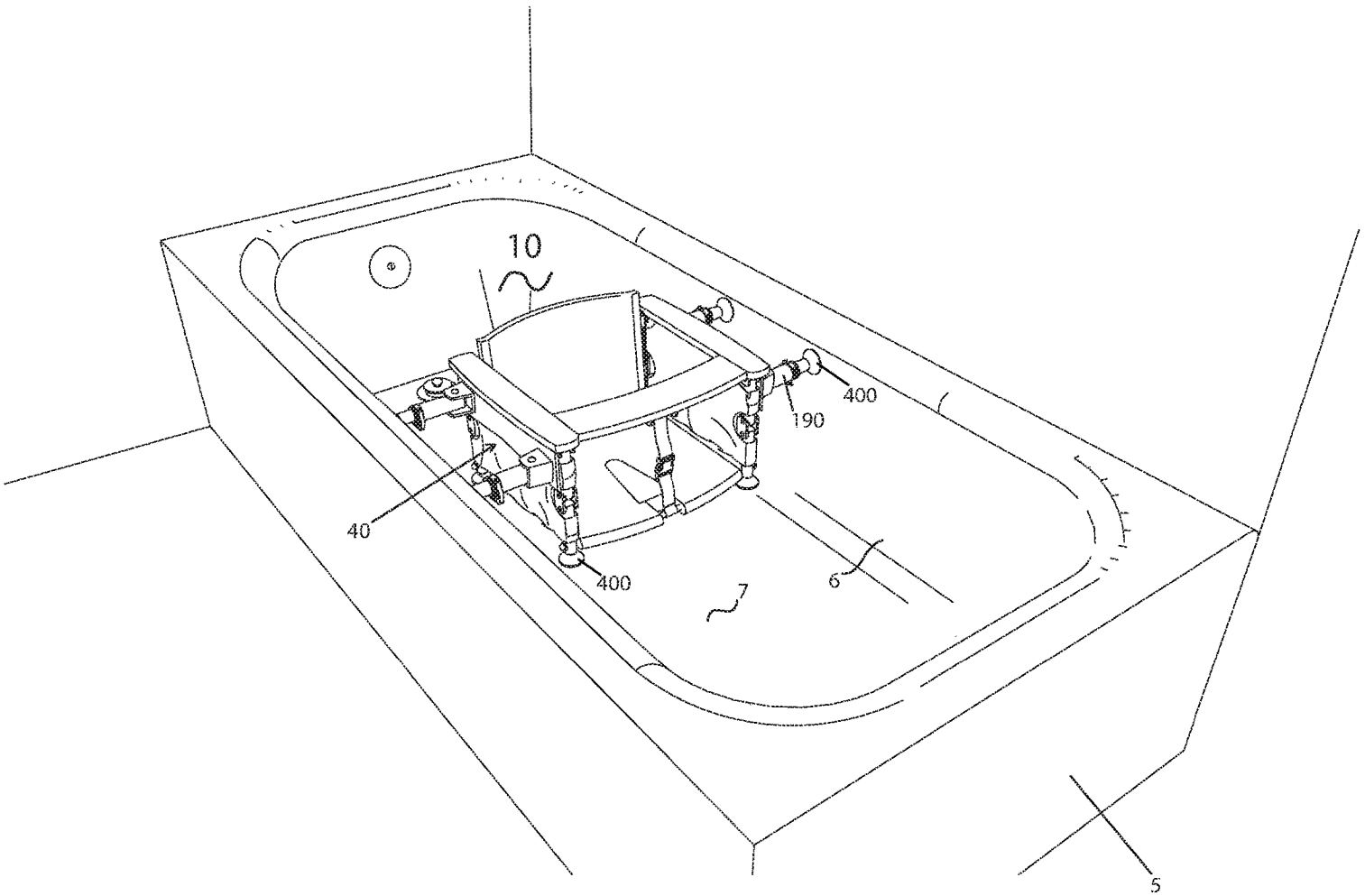
FIG. 14 is a demonstration of actual use of one of the embodiments of the present invention.

FIGS. 5*a* and 5*b* demonstrate the shafts 190 in a retracted state, folded against the hard flap 62. The hard flap 62 may additionally support the armrests 61 which are clearly shown. The stiff flap 62 provides a non-elastic support surface for the shafts 190, which exert a force on walls of a support surface such as the bathtub 5 (FIG. 14). This force is then linearly translated through the shaft 190 back against the upright supports 20 and 30. The hard flap 62 thus ensures that the walls 20 and 30 do not buckle and fall inwardly onto the horizontal member 100. Structurally, the distal ends of the hard flap 62 abut against the upright rails 97, or against the top rail 71, or against the combined frame formed by upright rails 97 and top rail 71. Alternatively, the upper rail 71 may house the mounting hinges 171 of the sockets 170.

Figure 6B:
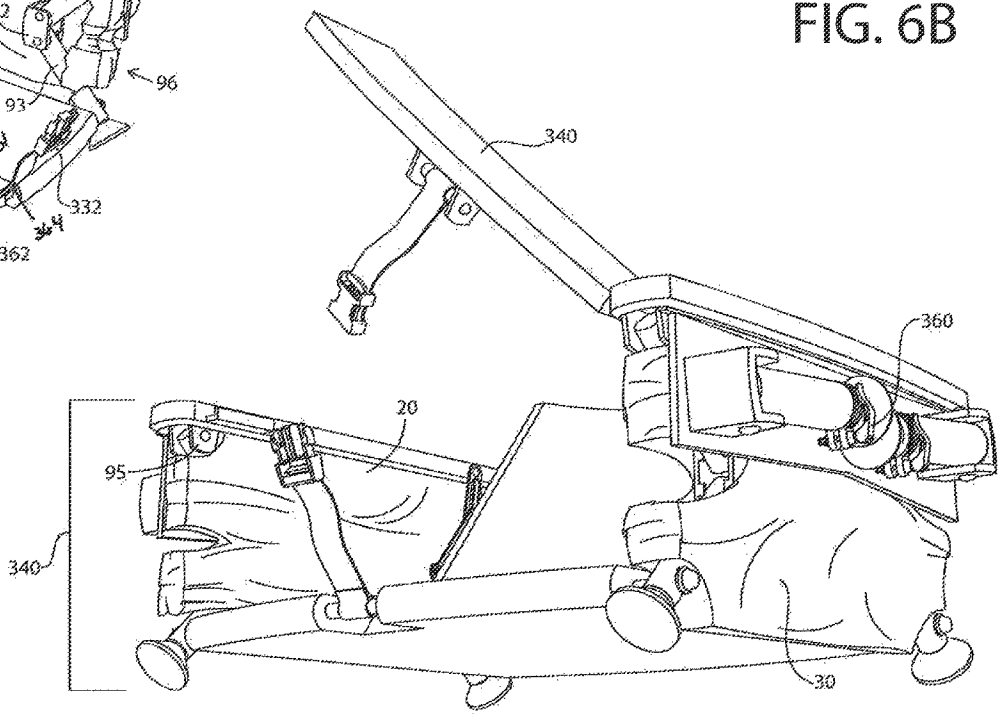
FIGS. 6A and 6B demonstrate the folding capability of the walls with immobility elements.
Figure 6A:
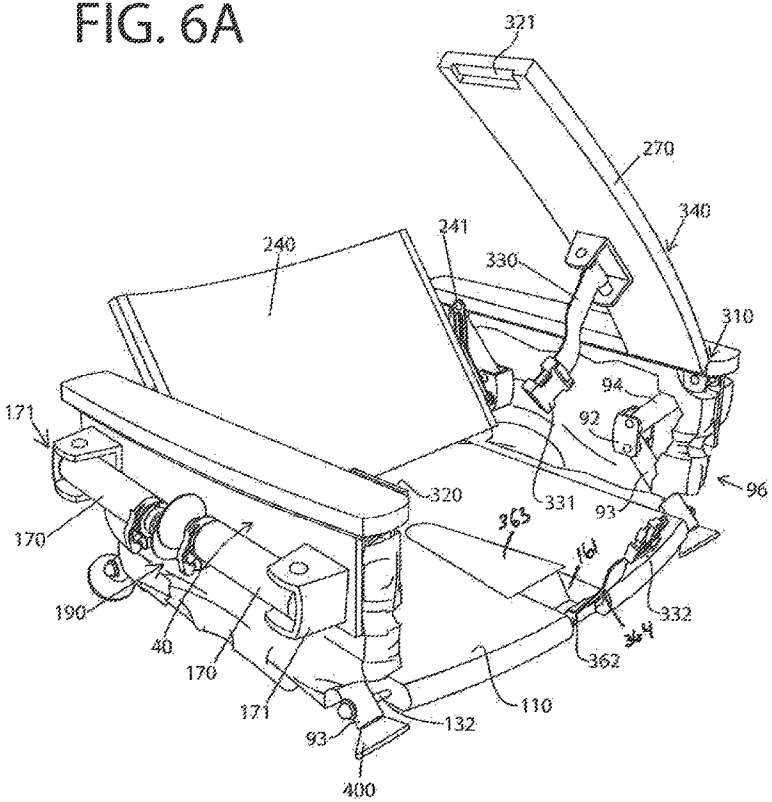

FIGS. 6A and 6B demonstrates one embodiment of the present invention in the process of being folded. The upright rails 96 are seen through a cutaway in FIG. 6A as folded at the latch 92, with top section 94 folding unto the bottom section 93. In this embodiment, the bottom hinge 91 is replaced with an axle 132, with bottom section 93 being secured to the seat 100 with an axle 132, with the bottom section 93 pivoting about the axle 132 as is folded or returned back into an erect position. Also shown is a slightly lower back support 240 and a utility bar 270 where the first end 280 and the second end 290 wrap around the upright rail 96 of the front edge 90, to provide further structural strength to prevent inward buckling of the sidewalls 20 and 30.

In FIGS. 6A and 6B, sidewalls 20 and 30 are shown as made out of fabric, while rear upright support 240 is a single unit that is made out of hard material. A stiff rear upright support 240 may be desirable to especially young children, or those with back pains, a stiff rear upright support 240 provides greater lumbar support. Sliding rails 241 assist in swinging of the rear upright supports almost horizontal and then by sliding the rear support 240 toward the seat 100, achieves the same or even lower profile as the folded walls 20 and 30.

FIGS. 6A and 6B further demonstrate the of utility bar 270, a hinge 310, a snap in connector 320, a crutch barrier 330, the latch portion of the squeeze latch 331 and the tongue portion of the squeeze latch 332, and the utility surface 340 having at least some of the benefits and features as presented heretofore with description of FIG. 2, as well as other not stated benefits and utilities. The snap connector 320 locks unto the latch 321 to locking the utility bar 270 into place between the first and second upright supports 20 and 30. In a locked position, the utility bar is intended to provide structural support for the upright supports or walls 20 and 30, to prevent them from buckling or leaning inward toward the horizontal support surface 100. The crutch bar 330 is shown having a squeeze latch 332. Additionally, the lower portion 364 of the crotch bar 330 is looped around the axle 362 that spans the aperture 162. The shafts 190 are fully collapsed and folded against within the sockets 170 along the outer plane 40. When fully folded the height 341 of this embodiment of the present invention is preferably between one and a half inches to five inches. The hinges 171 are shown to fold in only one direction, but are capable of inducing a 90 degree between fully unfolded and fully folded shaft 190.

Figure 7:
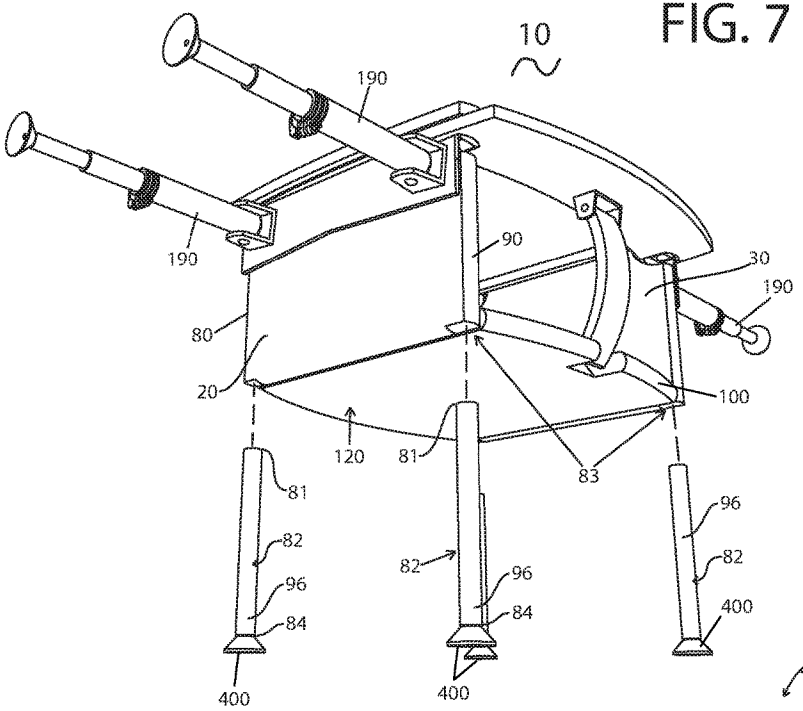
FIG. 7 demonstrates removable upright rails, which may also serve to level the chair device along the horizontal plane.

FIG. 7 is another embodiment of the present invention. The variation demonstrated in this figure is that the upright rails 96 are unitary rods that are inserted into the channels 83 at bottom surface 120 of the horizontal support member 100. The rod body 82 may contain male or female threading and engage the channels 83 which may have the opposite thread from the one on rod body 82. Having threads on the rails 96, or alternatively, height adjustable dip pins and dip pin holes will enable a horizontal leveling ability of the device 10, to remain upright despite uneven or inclined surfaces. The rails 96 then run the entire length of the channels 83 that form the back end 80 and the front end 90 of each wall 20 and 30. Also shown is the bottom surface 120 of the horizontal support 100 and suction cups 400 and the distal end 84.

Still describing FIG. 7, the inserted end 81 of the rod-like rail 96 may be narrower than the rest of the rod body 82. The bottom end of the rod-like rail 96 contains an immobility element, in this case the suction cup 400. The rails 96 shown in this environment may be hollow or solid, and may be tubular or parallelogramatic, and may be manufactured from plastics, metals, or light weight composite polymeric or metallic mixtures, which may or may not have conducting or non-conducting physical properties.

Figure 8:
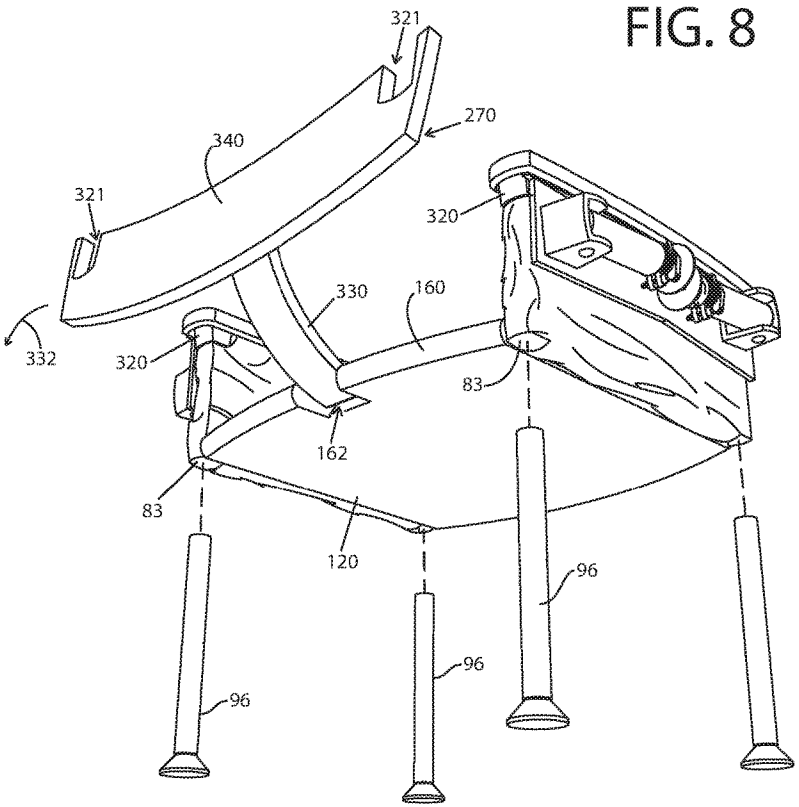
FIG. 8 demonstrates how the chair device of FIG. 7 folds once the upright rails are removed.

FIG. 8 is another configuration of the embodiment that is shown with a swingout utility bar 270. In a folded state, the utility bar 270 swings forward in direction 332 about of the crutch bar 330, which is shown as inflexible rod of material that pivots within the hinge 162 that is sunken into the aperture 161 of the bottom surface 100. When unfolded, with walls 20 and 30 are capable of remaining fully vertical and supported structurally in an erect position by the inserted rails 96. The utility bar 270 clips into the snap connectors 320 and feature a latch connector 321 within the utility bar 270. Such a latch connector 321 is capable of wrapping around the front ends 90 to further prevent sideways motion of the sidewalls 20 and 30.

Figure 9:
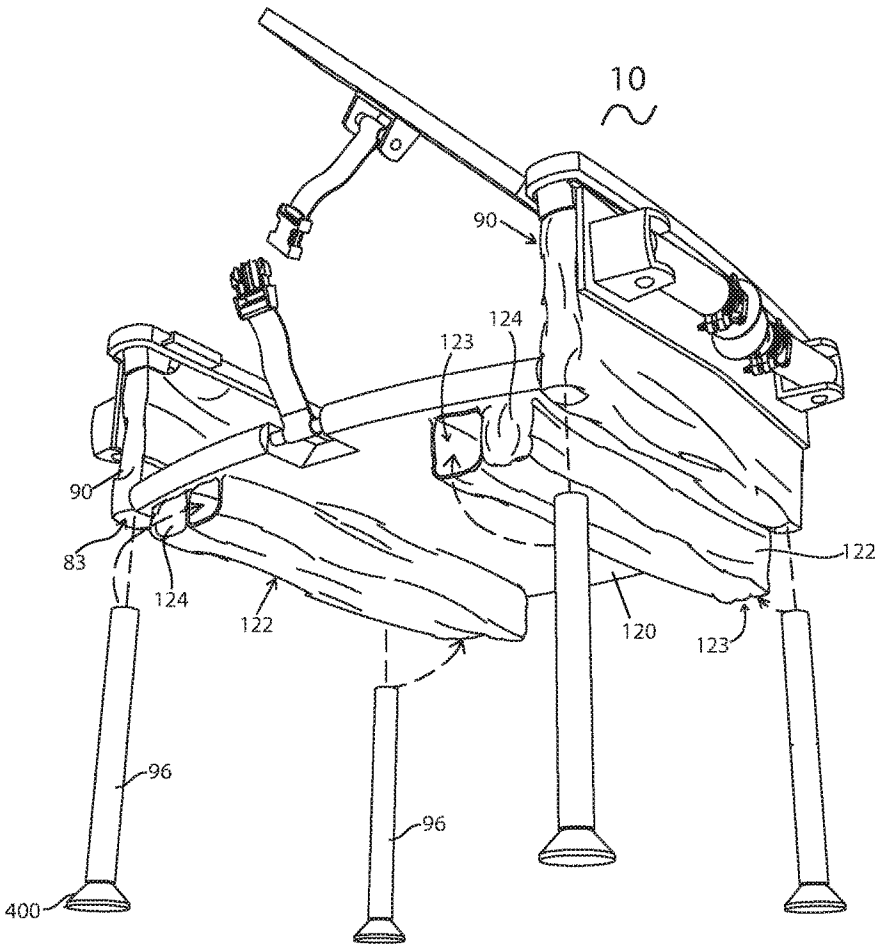
FIG. 9 storage compartments for the removable rigidity elements (rails) shown in FIGS. 7 and 8.

FIG. 9 demonstrates elements 122 with are storage compartments for rails 96, which may be removed to fold the device 10. The storage pockets 122 function as sheaths to keep the rails 96 tucked away while the seat 10 is folded for travel. Each rail 96 has its own compartment featuring an opening 123 and a closed off back end 124. The opening 123 and back end 124 are preferably configured in a staggered fashion, with close offend being followed by an opening 123 and then again by the closed off end. In this way, the storage pockets 122 can achieve a snug fit with the storage pockets 122 and yet still have plenty of room to accommodate the suction cups 400. The storage compartments or pockets are preferably made of flexible material or fabric, in order that when the rails 96 are within the channels 83, the storage pockets 122 can be crimped down so as to be substantially on the same plane as the bottom surface 120. Alternatively, the storage compartments 122 may contain frictional elements and be made of a stiff non-flexible material, to double as support stands for the rest of the device 10.

Figure 10:
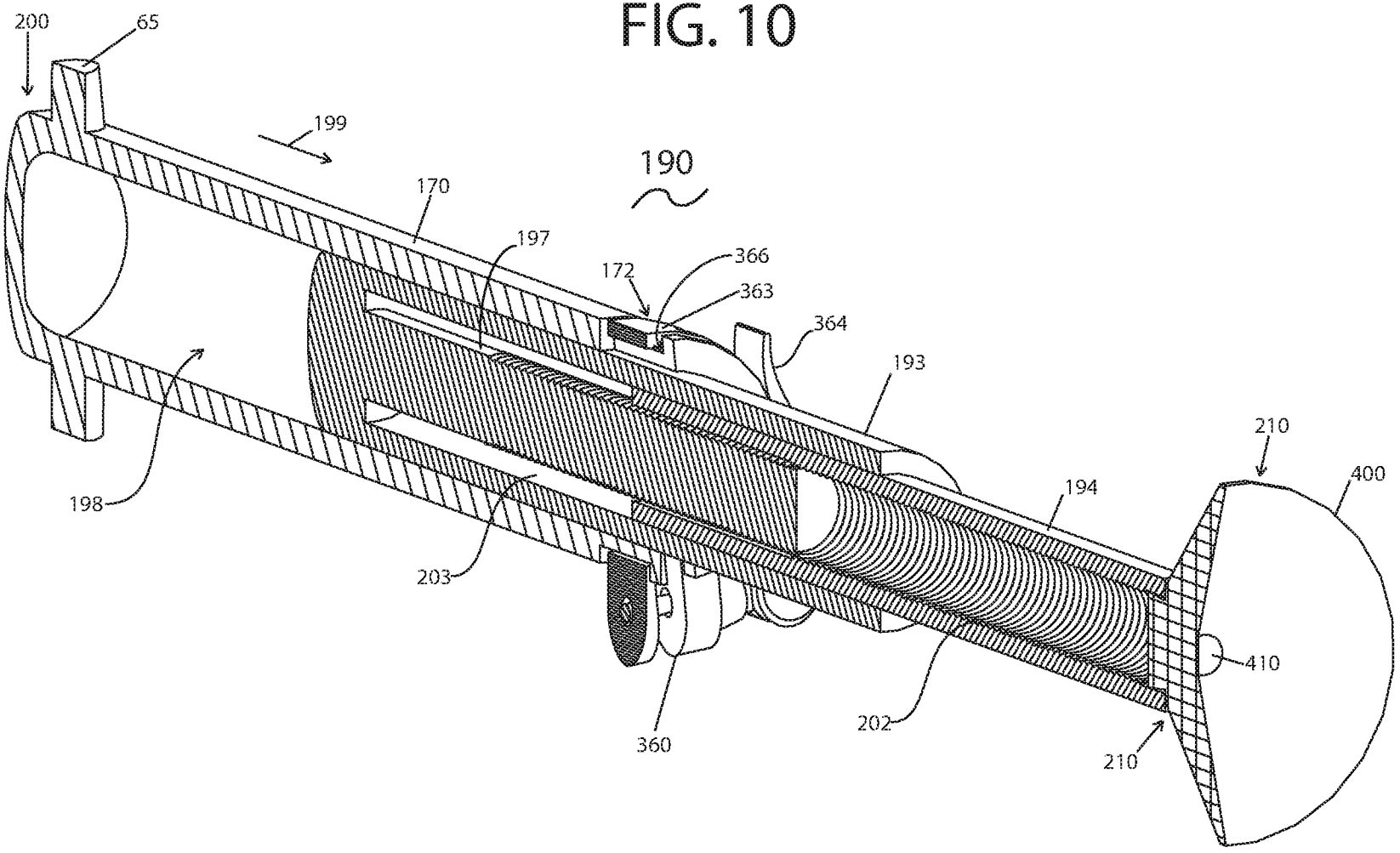
FIG. 10 is a cutaway diagram of one embodiment of the telescoping member otherwise referred to as the shaft.
Figure 11:
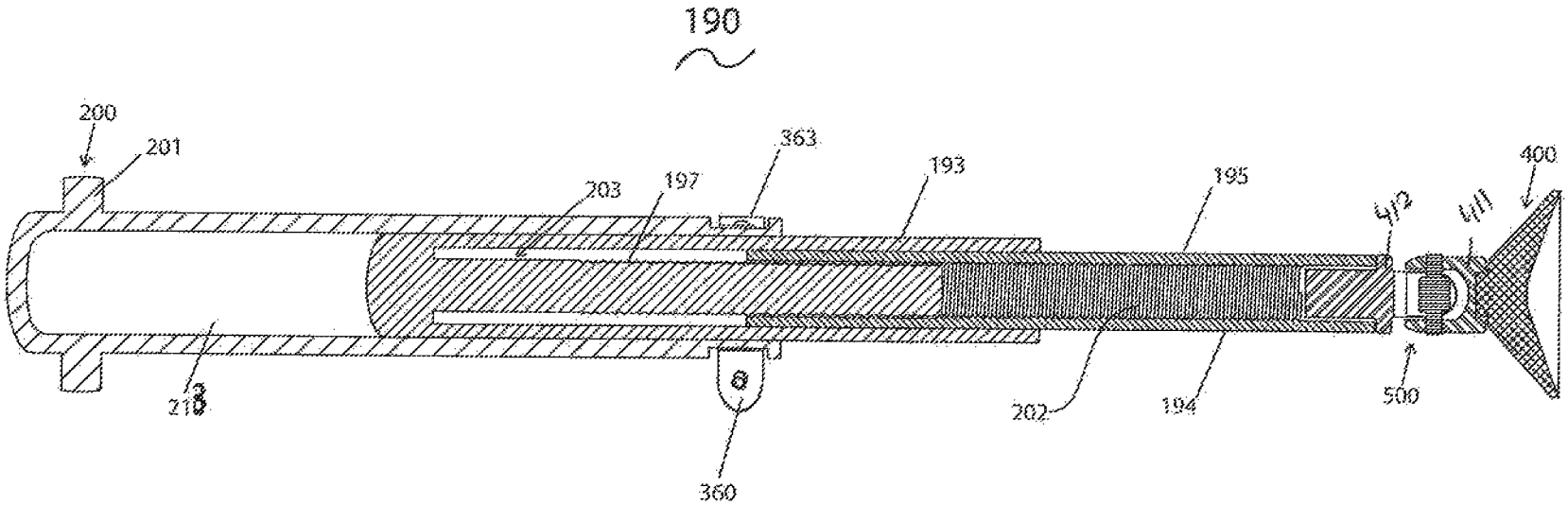
FIG. 11 is a side cutaway view of the telescoping member or shaft, this time featuring a universal joint at its distal end of the shaft.

FIGS. 10 and 11 are a cross section of the shaft 190. The shaft 190 is used to secure the seat 10 between the sidewalls 6 of a bathtub 5 (FIG. 14). Preferably there are two shafts 190 on each sidewall 20 and 30, facing outwardly and in ninety degree orientation to the outer surface 40. The shaft 190 works by forming a tension truss between a wall of a bathtub 5 and the wall of the seat 10. For the tension to be effective, shafts on both the first upright vertical support 20 and the second 30 must be extended and ajammed against the wall 6 of the bathtub 5 to a degree that no further lateral outward motion in the direction 199 is possible. When this point is reached, the shafts 190 on either side of the seat 10, as well as the seat itself forms a tension truss that spans the width of a bathtub 5, and is thereby immobilized within said bathtub 5.

Demonstrated in FIGS. 10 and 11 are telescoping elements that form the corpus of the shaft 190, comprising a socket 170, a pivot or a joint axle 65 that is then disposed within the hinge 171, a first telescoping element 193 and a second telescoping element 194. The first telescoping element 193 is within a linearly slidable relationship with the socket 170. The socket 170 is the portion of the shaft 190 that is mounted unto the hinge 171 that is mounted directly on the upright support elements 20 and 30. The extension distance between the socket 170 and the first telescoping element 193 is regulated in this embodiment using a pressure clamp 360, which is disposed at the distal end 172 of the socket 170 and which forms a channel 366 suitable for accommodating the clamp band 363. During the process of extension or retraction of the shaft 190, the lever arm 364 of the clamp 360 is oriented nearly perpendicularly to the axis of the clamp band 363 and thus remaining in a released state. In this orientation of the clamp arm 364, the first telescoping element 193 may freely slide in a linear direction within the cavity 198. Once the desired length of extension or retraction of the first telescoping element 193 is reached, the level arm 364 is lowered, thus tightening the constriction band 363. The chocking effect of the constriction band 363 caused the channel 366 to exert pressure on the first telescoping element 193, immobilizing it within the cavity 198.

The loosely sliding relationship between the socket 170 and the first telescoping element 193 are preferred to achieve a close to optimal extension or retraction length of the shaft 190 within a very short time. If at that point the shaft 190 is not optimally extended, for example the suction element 400 is not quite reaching the wall 5, the user can then more precisely and gradually adjust the overall extension of the shaft 190 by using the threaded engagement on the wall of the cavity 202 of the second telescoping element 194 and the opposing thread 197 of the dipping channel 203 within the first extension element 193. Thus, at all times a user extends or retracts quickly between the socket 170 and the first telescoping element 193 and then able to more precisely and gradually adjust the extension by radially rotating the second extension element 194 to achieve the maximum degree of tension against the wall 6 of bathtub 5, or a similar supporting surface. The distal end 210 preferably contains a ball bearing at the distal end 210, where the first telescoping element is fitted with a suction cup 400. The ball bearing is desirable to ensure that the second telescoping elements 194 can continue to twist freely even when the suction cup 400 is already secured to a support surface. The fastener or rivet 410 connects any such ball bearing with the suction cup 400. The suction cup 400 is preferably capable of independent rotation with respect to the radial rotation of the first telescoping element 193. The distal end 210 may contain a universal joint 500 to enable a secure connection of the distal end 210 against a supporting surface in a circumstance where the supporting surface is somewhat slanted (some degrees away from being completely perpendicular to the support surface 5) or uneven, or in the event that the outer surface 40 of the sidewall 20 or 30 is not exactly parallel with said support surface.

Still referring to FIGS. 10 and 11, the inner cavity 202 of the second telescoping element 195 contains a thread that is matched to the thread 197 of the dipping channel 203. There is no thread between the socket 170 and its internal cavity 213 and the first telescoping element 193. Alternatively, there may be a groove thread between the cavity 2130 and the wall of the first telescoping element 193. The groove will thus assist in keeping the shaft in an extended fashion without the need to fully engage the shafts 190. Shown in this figure is just one embodiment of a telescoping shaft 190 and other telescoping elements may be possible. The preferred full extension length is approximately between three inches when fully retracted to three feet when fully extended. FIG. 11 also demonstrates the cross section of the universal joint 500, which may pivot towards the right, left, up and down, as well as to rotate the shaft 190 without disengaging the suction cup 400.

Figure 12:
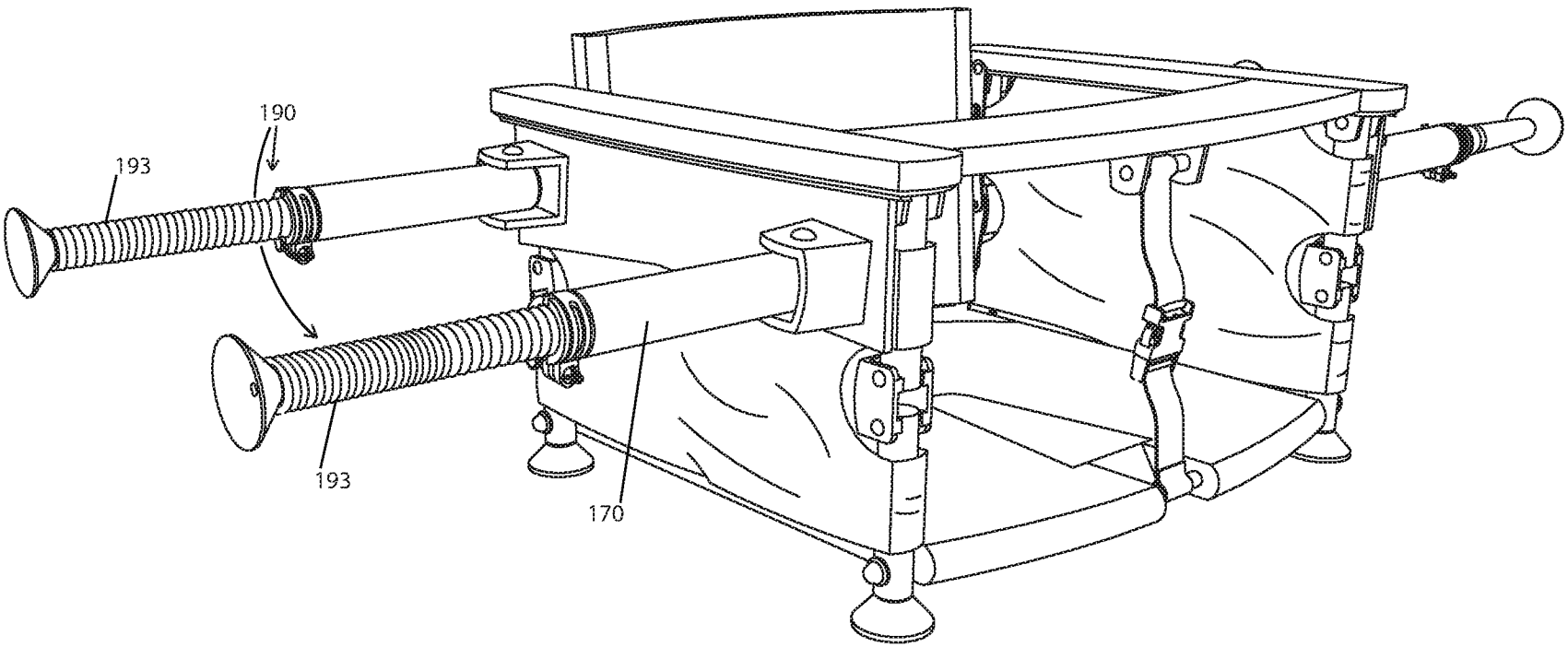
FIG. 12 is a perspective view of another embodiment of the present invention, with one of the telescoping components being replaced with a spring (193), thus possibly eliminating the need for a universal joint at the distal end of the shaft.

FIG. 12 is yet another embodiment of the present invention, showing the first telescoping element 193 in form of a spring. The spring permits some up and down motion of the seat 10 and may enable securing of suction cups at an angle to the horizontal axis corresponding to the fully extended shaft 190.

Figure 13:
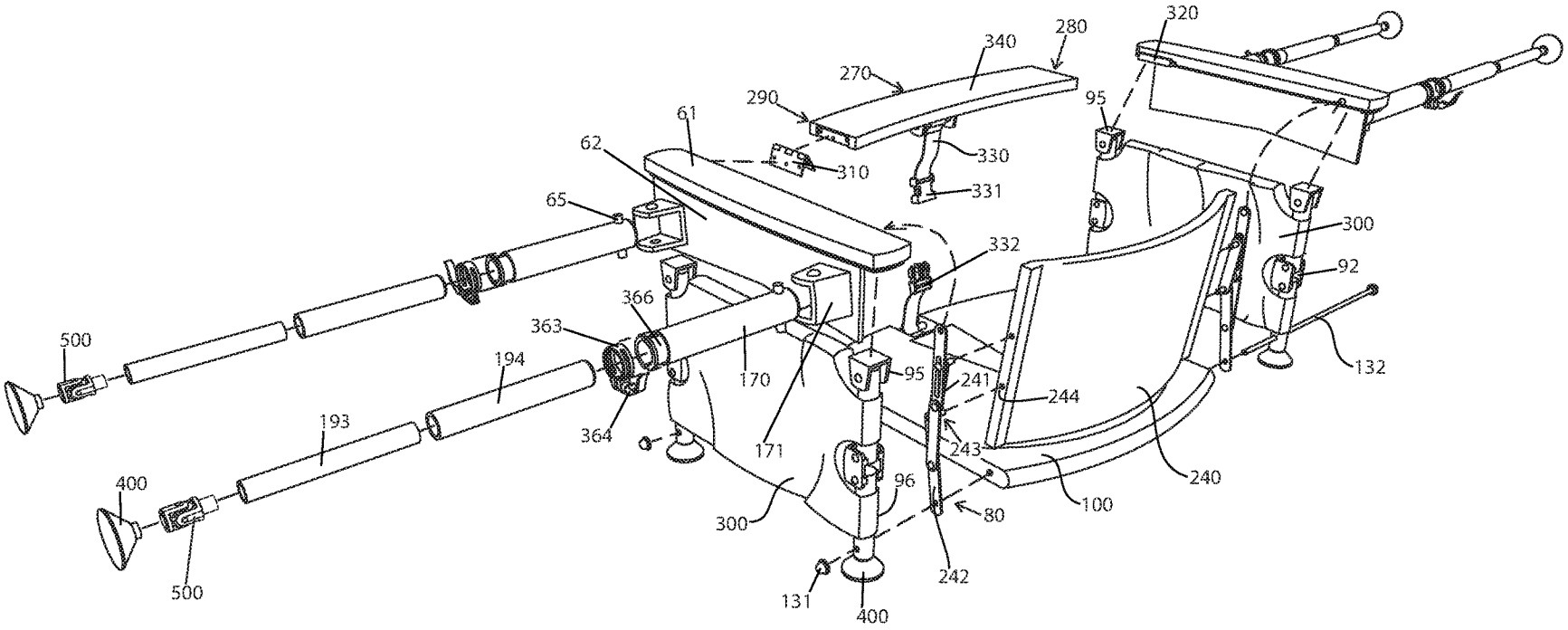
FIG. 13 is an exploded view of one of the embodiments of the present invention.

FIG. 13 is an exploded perspective view of the present invention. Shown are the immobility elements, which are preferably suction cups 400, the first telescoping element 193, the second telescoping elements 194, the clamp 360 having a band 363 and a lever arm 364 that is secured within a channel 366. The socket 170 is secured within the hinge 171, by the joint axle 65. The hinge 171 may also rotate clockwise and counter clockwise within its mount point. Also shown are the upright rails 96 that hold the seat 10 in an erect and unfolded position. The upright rails are secured at the bottom with an axle 132 traversing through the horizontal member 100, and with a hinge 95 at the top. A hinge 91 may be used instead of the axle 131. The hinge 95 also supports the arm rest 61 and the stiff flap 62 that houses the hinges 171. One of the armrests 61 contains a snap connector 320 of the utility bar 270. The utility bar 270 is then pivotetly connected through the hinge 310 to the wall of the seat 10 at the second end 290 of the utility bar 270. The rear back rest 240 is shown being mounted on a complex hinge 242 that gets affixed to the upright rail 96 at the back end of the device 80. The complex hinge 242 contains a channel that enables the backrest 240 to be pushed down into a near perfect horizontal position. The complex hinge 242 contains fastener points 243, which are mounted within openings 244 in a pivotal, temporary or permanent fashion. Other components shown have been described previously or will be described in later figures.

FIG. 14 is an example of usage of the seat 10 in the intended setting, namely a bathtub. Additionally, the seat 10 may be used and secured within any relatively narrow space between any two substantially parallel support surfaces, such as walls 6, which would enable the formation of a tension truss through the combination of opposing shafts 190 pressing against the wall 6 of the bathtub 5, and rigid walls 20 and or 30, thus completing the full rigid frame that forms a single truss that spans the width of the bathtub. In this figure, one skilled in the art can appreciate that the present invention is secured to the sides 6 of the tub 5 with shafts 190. At the same time, it is further immobilized and removably attached to the tub bottom surface 7 with suction cups 400 or other devices suitable for restraining movement of the apparatus 10.

Figure 15:
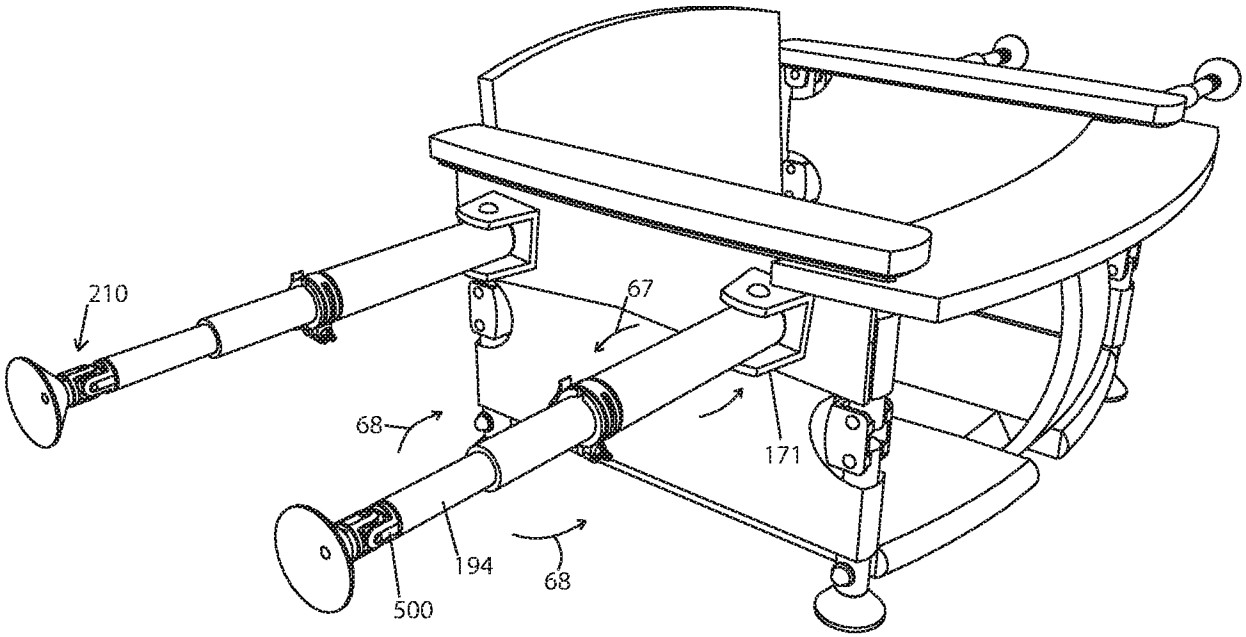
FIG. 15 is a perspective view the present invention, demonstrating universal joints.

With shafts 190 being substantially on a horizontal plane, a wall 6 oriented at an angle sloping away from or towards the outer surface 40 would present a challenge to secure the suction cups 400 of the shafts 190 to said support surface. To resolve this shortcoming, the suction cups are preferably attached to the distal end 210 through a universal joint that is clearly demonstrated in FIG. 15. The universal joint 500 is disposed at the distal end 210 of the second telescoping element 194 (or any element of the shaft 190 that by its position forms the distal end 210). The universal joint is able to orient and rotate the suction cup 400 to assume many angles with respect to the plane of the shaft 190, to remain substantially parallel with a support surface. The universal joint 500 is able to rotate axially 67 (clockwise or counter clockwise) and linearly 68 (from front to back). Similarly, the hinge 171, may also cause the shaft to be folded in an arch 68 and rotate in the axially 67.

Figure 16:
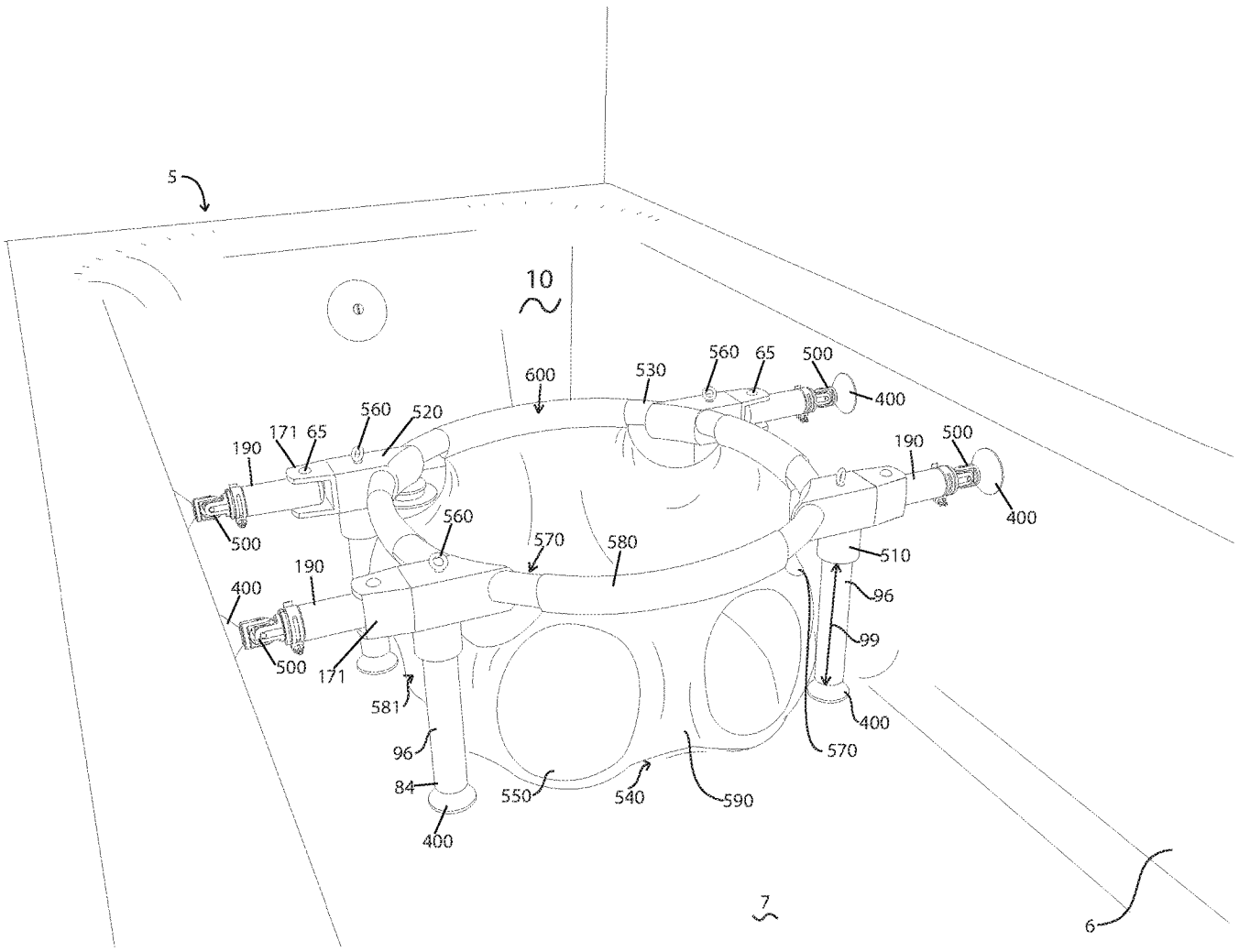
FIG. 16 is another embodiment of the present invention having soft or fabric-like walls demonstrating an application thereof. This figure also demonstrates one application of the disclosed device.

FIG. 16 is another alternative embodiment of the present invention. In the embodiment shown, the rigid supports 20 and 30 and 240 are replaced with one soft basket like sack 540. The sack 540 contains leg openings 550 placed catty-cornered from sides 581 to the front 590. The sack 540 is suspended from a rigid horizontal elliptical brace 530 with long loops or channels 580 that wraparound said brace 530 and are in a preferably slided coupling therewith. The rigid elliptical brace 530 encircles the entire top portion 600 of the device 10 and serves as the mounting point for the shafts 190 that are mounted within the hinges 171. The shafts 190 has been described at length in the preceding figures, but essentially further comprise telescoping elements as illustrated before, a universal joint 500 that is wedged between frictional elements, namely a suction cup 400 and the first telescoping element 194. The shaft 190 is pivotedly connected to the hinge 171 with the joint axle 65. The hinge 171 in the embodiment shown, is connecting to the brace 520, which juts out laterally toward the sides 571, and compensates for the rounded shape of the elliptical brace 530. The connecting brace 520 further contains the downwards socket 510 which houses the upright rail 96 and a hookup loop 560, which will be further described below. To allow for an uninterrupted and secure connection between the elliptical brace 530 and the connecting brace 520, the sack 540 contains gaps 570 in the upper loops 580. The sack 540 may be made from a cloth, burlap, flannel, rubber, cotton, wool or a synthetic material.

As shown in FIG. 16, the embodiment of the present invention is disposed within a bathtub 5, having walls 6 and bottom surface 7. The apparatus 10 is securely wedged within the bathtub 5 with shafts 190 that are pressing against the sides 6 on each side 581 of the apparatus 10, and which is suctioned to the bottom surface 7 with suction cups 400 that are disposed at distal ends 84 of upright rails 96. The upright rails 96, provide optimal elevation to sit a child in a position that is comfortably elevated above the bottom surface 7. The preferred length 99 of the upright rails is preferably between six inches and one and a half feet. The upright rails 96 may be telescoping to increase height adjustment capabilities or to compensate for the often sloping grade of the support surface 7 of the bathtub 5.

Figure 17:
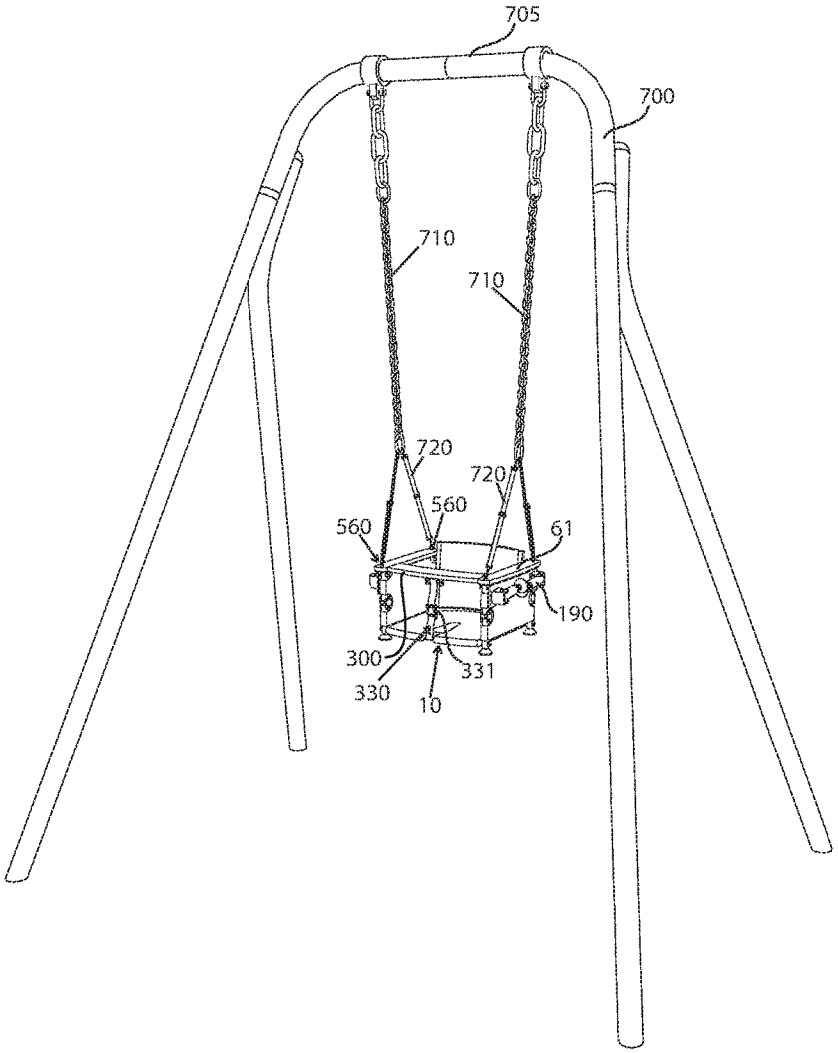
FIGS. 17 and 18 demonstrate additional applications for some of the embodiments of the present invention.

FIG. 17 demonstrates another application of the present invention. Shown is the embodiment having rigid walls as shown in FIGS. 1-15. Shown is a swing frame 700 with the device 10 suspended from the upper brace 705 of the swing frame 700 with chains 710. Y-shaped tethers 720 are stretched between the chain 710 and the hookup loops 560. The y-shaped tethers 720 can be clipped unto or threaded through the hookup loops 560. While device 10 is being utilized as a bathing chair, the hookup loops 560 remain unengaged. Alternatively, the hookup loops may be removable, with just a threaded, carabiner or bayonet socket located in the arm rests 61 or at the top of the connecting brace 520 as shown in FIG. 16.

Figure 18:
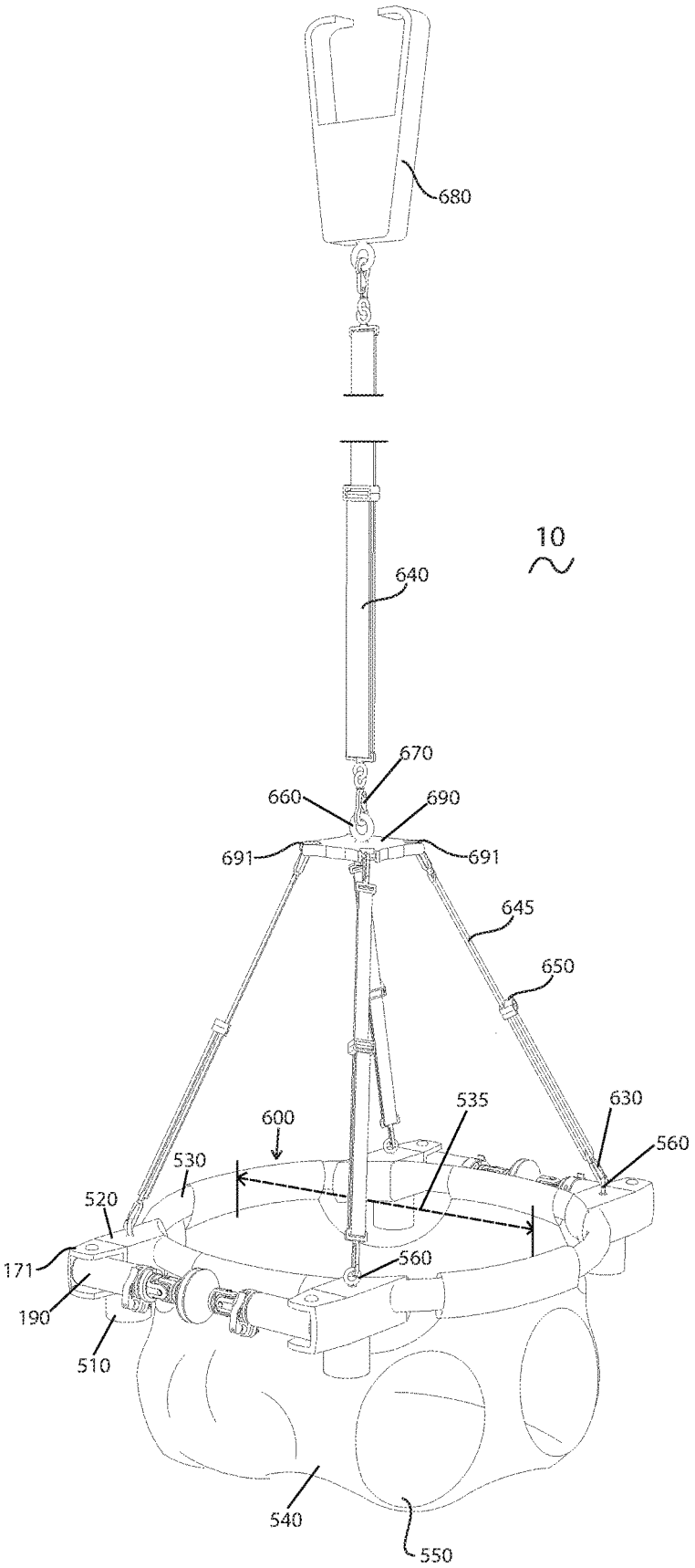

FIG. 18 is yet another application of the present invention demonstrating versatility of the apparatus 10 in utilizing various attachments. Shown is the embodiment having an elliptical brace 530 with lateral connecting braces 520. Protruding from the top of the connecting brace 520 are hookup loops 560. The elliptical brace 530 may be manufactured out of plastic, steel, iron or wood, or a composite material or any other rigid and inflexible material. It may be made out of sections which may be removable or telescoping to reduce the diameter 535. The device 10 is suspended from some upper support, like an i-beam or a door lintel with a u-connector 680, tethered thereto with suspension strap 640. The strap 640 contains a carabiner connector 670 on the end most proximal to the device 10. The carabiner connector hooks into the loop 660 that is at the top of the spreader platform 690. At each corner of the three or four corners 691 of the spreader platform 690 is a tether strap or chain 650 that connects to the hookup loops 560. Either or both the tether strap 645 and the strap 640 may be elastic. The purpose of this application is to suspend the device 10 from an upper support using the u-connector 680. A child can be seated inside the sack 540 from the upward direction 600, with child's legs protruding from the openings 550. The strap 640 and tether straps 645 will then stretched downward under the weight of this child, until the child's feet are able to just touch a supporting surface, such as a floor. The child can then use this device, which may have just been removed from the inside of a bathtub as shown in FIG. 16, as leg muscle training jumper or a walker trainer. Shown clearly in this figure is the diameter 535 or the general width of the elliptical brace 530, which is preferably between one to three feet.

Figure 19:
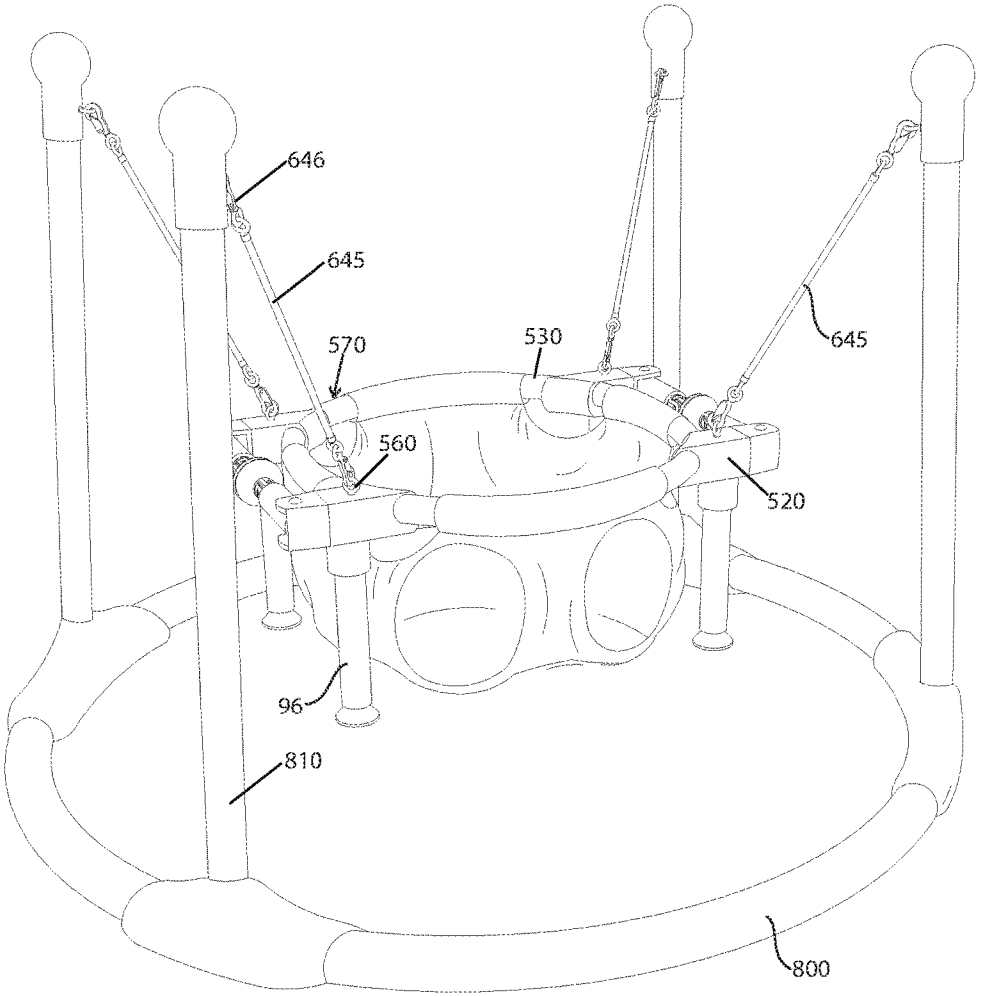
FIG. 19 is another application of the present invention.

FIG. 19 is still another application of the present invention. The device 10 is another type of bouncer or walker trainer. The hookup loops 560 engage flexible tethers 645. Distal ends 646 are connected to upright posts 810, which may connect to a base 800 as shown in the figure, or may connect to a different type of a base. The device 10 remains completely unchanged between each application, with any unnecessary components either removed, as demonstrated in reference to upright rails 96 missing in FIG. 16, or tucked out of the away as shown in reference to the shaft 190.

Figure 20:
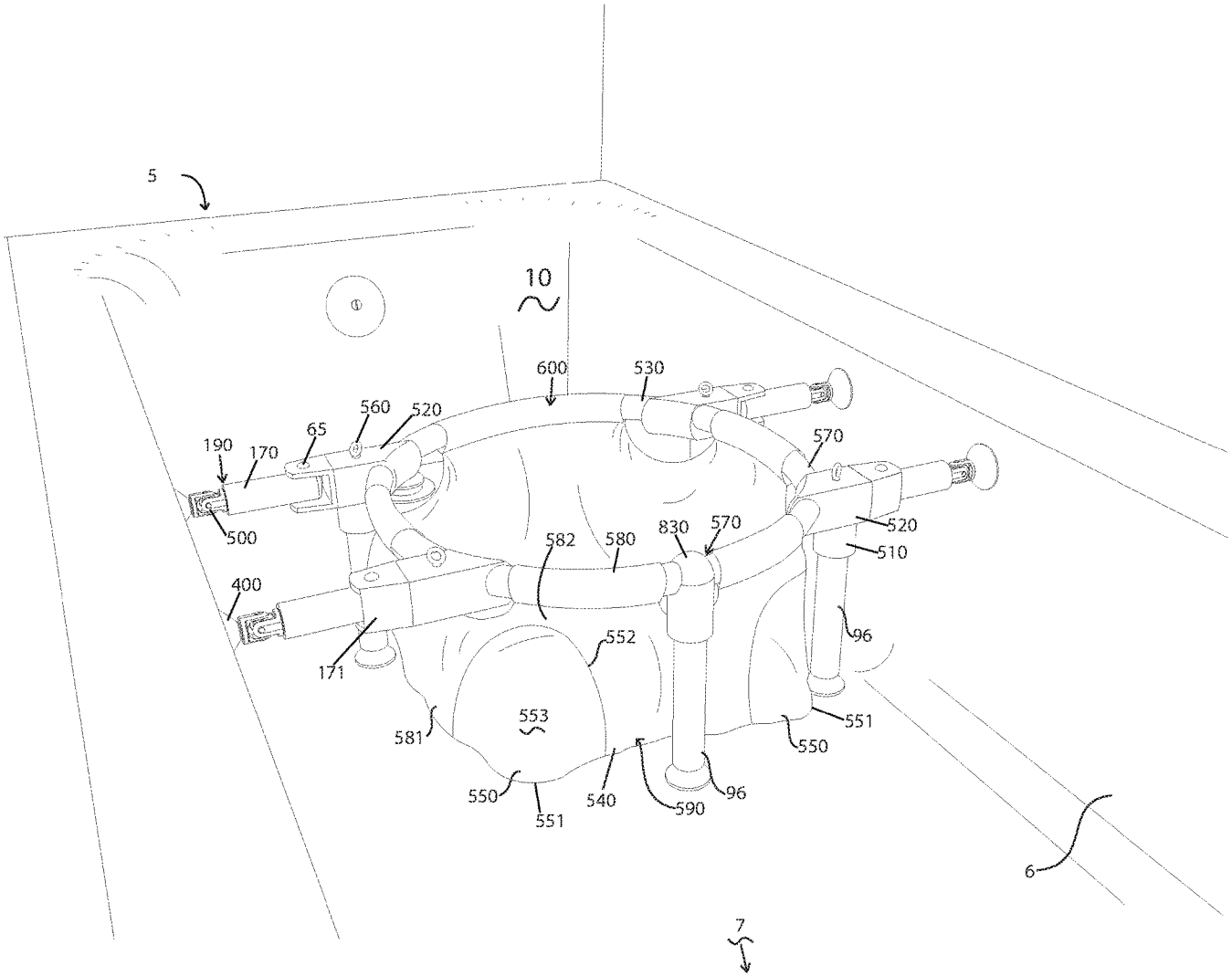
FIGS. 20 and 21 is another embodiment of the present invention showing application thereof.

FIG. 20 is still another variation of the present invention. In this figure the forward facet 540 of the device 10 contains a single upright rail 96 as opposed to two forward upright rails 96, as shown in FIG. 16. For this reason the forward placed structural braces 520 do not contain the downward socket 510. Instead a centrally located downward socket ring 830 is mounted onto the elliptical brace 530, in the front 590 between the feet openings 550. The feet openings 550 in this embodiment are oriented in an opposing catty-cornered orientation to each other and at an angle with respect to the front 590 and the sidewalls 581. The arches 552 form the angle 582 to achieve a less obstructed and more natural position of toddler's feet. The distance from the bottom edge 551 and the apex of the arches 552 is preferably between two and five inches. The centrally located downward socket ring 830 may also be clamped onto the elliptical brace 530 without removing any additional section of the long loop 580.

The apparatus 10 shown in FIG. 20 may be fully disassembled for storage repair and reconfiguration. For example, the structural brace 520 contains an opening to fasten the downward socket 510 or the hinge 171. The hinge 171 may be removed from the rest of the structural brace 520. The shafts 190 may be fully removed from the hinges 171, and telescoping members from within the sockets 170. The gaps 570 may be machined in place or created by a user through utilization of perforated/removable sections of fabric or other type of surface.

Figure 21:
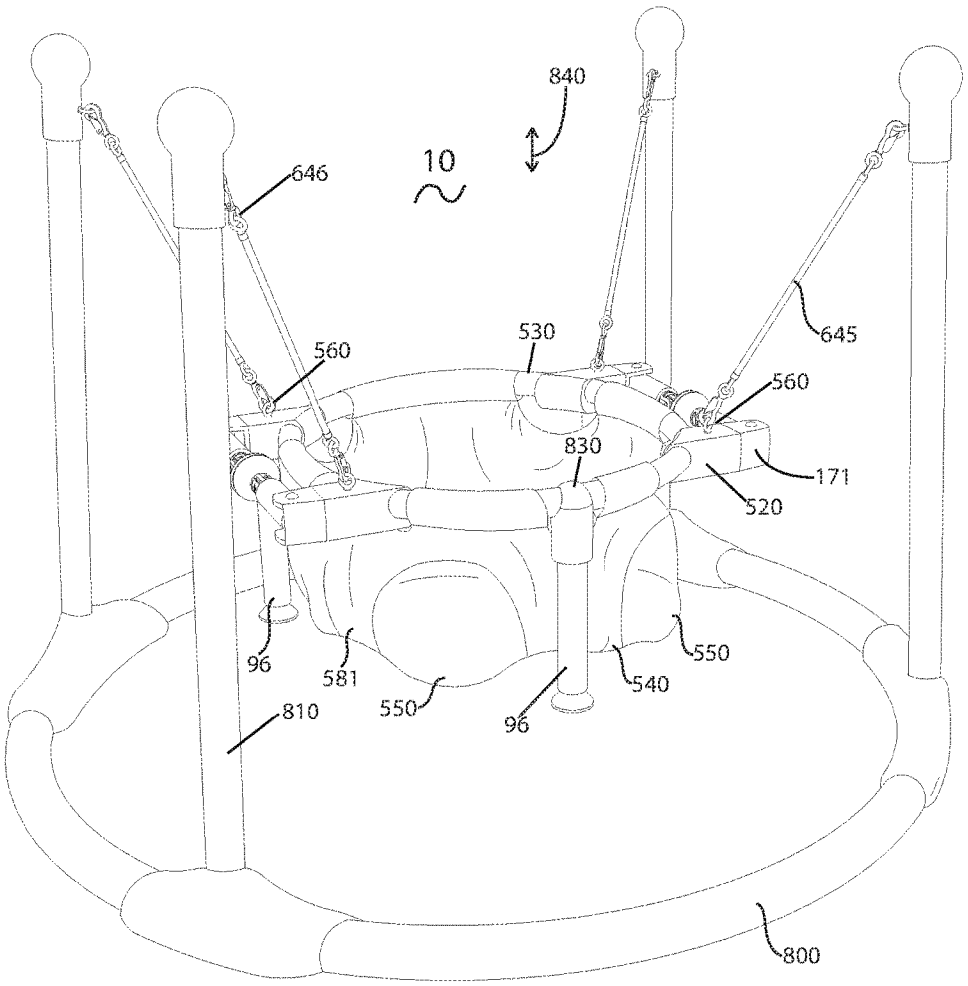

FIG. 21 demonstrates the application of the diagonal openings for feet 550. A child using the present device 10 will insert feet into the openings 550 from inside the sack 540 and would remain in a squatting position with heels of feet resting on a supporting surface inside an elliptical support base 800. The child would then drive his or her fit into the ground and thus be propelled upward and back downward in the motion indicated numerically as 840. The diagonal openings for feet 550 may be slid further back toward the sidewall 581, or more toward the from 590 since the sack 540 is hanging loosely from the elliptical brace 530 on the long loops 580. If greater stability is desired, one may reattach the upright rails 96 to the frontal structural braces 520 and remove the single structural brace 96 from the front, along with the downward mounting ring 830. The elliptical ring 530 may additional contain ball bearings or wheels that may fit into a channel bracket (not shown), which would enable the apparatus 10 to fully rotate horizontally using the channel bracket All structural components of the present invention may be made from metals, plastics, wood or composite materials. Similarly, the sack 540 may be made from a flexible naturally occurring or manmade materials.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed:

1. A child safety apparatus comprising, a sack having two openings for insertion of feet of a person; a top of said sack further comprising a long loop enveloping an elliptical brace; said elliptical brace oriented horizontally with respect to said apparatus and further comprising at least three connector braces; each said connector brace jutting out laterally from said elliptical brace having a socket for housing an extendable shaft; wherein said shaft is able to pivot and rotate within a hinge of said socket; wherein said long loop having cutouts to permit direct mounting of said connector brace to said elliptical brace; and frictional elements disposed at each distal end of each said telescoping shaft.

2. The child safety apparatus of claim 1, wherein said connecting brace further comprises a removable downward facing socket for a removable coupling with an upright rail; wherein said removable downwards rail having a frictional element on the end that is opposite the end housed within said downward facing socket.

3. The child safety apparatus of claim 1, further comprising hookup loops disposed at the top of each said connector brace; wherein each said hookup loop may be removably coupled with a group comprising a tether connecting to an upright post, or to a y-connector connecting to a chain that is suspended from a frame, or to a tether suspended from a single strap of material mounted to an upper support surface.

4. The child safety apparatus of claim 1, further comprising a downward socket ring for removable housing of an upright rail, said downward socket ring mounted directly on said elliptical brace.

5. The child safety apparatus of claim 1, wherein said upright rail is comprised of telescoping individual members.

* * * * *